US005361791A

United States Patent [19]

Chapman et al.

[11] Patent Number: 5,361,791

[45] Date of Patent: Nov. 8, 1994

[54] CLEANING OF THE EXTERIOR SURFACE OF A PIPELINE TO REMOVE COATINGS

[75] Inventors: Gordon R. Chapman, Houston, Tex.; Charles M. Reid; James B. Seale, both of Edmonton, Canada; Donald R. Andruik, Houston, Tex.

[73] Assignee: CRC-Evans Rehabilitation Systems, Inc., Houston, Tex.

[21] Appl. No.: 137,589

[22] Filed: Oct. 15, 1993

Related U.S. Application Data

[63] Continuation of Ser. No. 801,707, Dec. 2, 1991, Pat. No. 5,265,634, which is a continuation of Ser. No. 592,140, Oct. 3, 1990, Pat. No. 5,092,357, which is a continuation-in-part of Ser. No. 486,093, Feb. 28, 1990, Pat. No. 5,074,323, which is a continuation-in-part of Ser. No. 197,142, May 23, 1988, Pat. No. 5,052,423, which is a continuation-in-part of Ser. No. 55,119, May 28, 1987, abandoned.

[51] Int. Cl.[5] ..... B08B 3/02

[52] U.S. Cl. ..... 134/122 R; 134/181; 134/172; 134/199

[58] Field of Search ..... 134/181, 172, 200, 199, 134/64 R, 122 R; 16/375

[56] References Cited

U.S. PATENT DOCUMENTS

| | | | |
|---|---|---|---|
| 1,375,979 | 4/1921 | Taber . | |
| 1,611,920 | 12/1926 | Kinzbach . | |
| 1,796,691 | 3/1931 | Jansen . | |
| 1,815,573 | 7/1931 | McManis . | |
| 1,821,352 | 9/1931 | McManis . | |
| 1,829,831 | 11/1931 | Hiskey . | |
| 1,899,379 | 2/1933 | Adams . | |
| 1,910,497 | 5/1933 | Peik . | |
| 1,926,387 | 9/1933 | Jansen | 91/43 |
| 2,044,778 | 6/1936 | Halstead | 91/30 |
| 2,053,307 | 9/1936 | Wilson | 25/38 |
| 2,290,106 | 7/1942 | Longstreet | 16/375 |
| 2,302,196 | 11/1942 | Downs et al. | 15/104.04 |
| 2,460,989 | 2/1949 | Kraner | 144/208 |
| 2,556,116 | 6/1951 | Smith | 263/2 |
| 2,576,861 | 11/1951 | Shaw et al. | 144/208 |
| 2,611,146 | 9/1952 | Buckley | 15/210 |
| 2,621,446 | 12/1952 | Russell | 51/14 |
| 2,651,312 | 9/1953 | McBeth | 134/122 R |
| 2,685,293 | 8/1954 | Dauphinee et al. | 134/199 X |
| 2,782,436 | 2/1957 | Tomer | 15/104.04 |

(List continued on next page.)

FOREIGN PATENT DOCUMENTS

| | | |
|---|---|---|
| 988403 | 5/1976 | Canada . |
| 1043056 | 11/1978 | Canada . |
| 1080918 | 7/1980 | Canada . |
| 1131418 | 9/1982 | Canada . |
| 1211352 | 9/1986 | Canada . |
| 0000808 | 2/1979 | European Pat. Off. . |
| 0105545 | 4/1984 | European Pat. Off. . |

OTHER PUBLICATIONS

M. Hashish, "Cutting With Abrasive Waterjets", *Mechanical Engineering*, pp. 60–69, Mar., 1984.

Canadian Ultra Pressure Services Inc. Bulletin, one page, published Nov., 1987.

Canadian Ultra Pressure Services Inc. Brochure, 28 pages, published Dec., 1987.

NLB Corp. Brochure, pp. 8,9, and 13.

ADMAC Brochure, "Model 5035 Jetlance TM MKII System", 4 pages.

ADMAC Brochure drawing, single page.

*Primary Examiner*—Frankie L. Stinson

*Attorney, Agent, or Firm*—Richards, Medlock & Andrews

[57] ABSTRACT

Apparatus for the cleaning of the exterior surface of a pipeline or the like includes a frame defining a longitudinal passage of a size sufficient to permit the pipeline to extend longitudinally therethrough. A first cleaning unit and a second cleaning unit are mounted on the frame. Each cleaning unit includes a plurality of jet modules. In turn, each jet module includes a rotatable jet nozzle mounted to deliver a jet of cleaning liquid toward the pipeline exterior surface. A high pressure cleaning liquid source is also provided and is connected to the rotatable jet nozzles to provide high pressure cleaning liquid to the nozzles.

37 Claims, 15 Drawing Sheets

U.S. PATENT DOCUMENTS

| | | | |
|---|---|---|---|
| 2,790,230 | 4/1957 | Sobek | 29/81 |
| 2,837,203 | 6/1958 | Reese | 16/375 |
| 2,858,555 | 11/1958 | Medovick | 134/199 X |
| 2,869,291 | 1/1959 | Clay | 51/14 |
| 2,896,644 | 7/1959 | Emanuel | 134/99 |
| 2,900,992 | 8/1959 | Johnson | 134/122 R |
| 2,933,802 | 4/1960 | Fuchs | 29/90 |
| 3,023,756 | 3/1962 | Proctor | 134/57 |
| 3,033,215 | 5/1962 | Miller | 134/98 |
| 3,050,759 | 8/1962 | Betzel, Sr. | 15/104.04 |
| 3,086,537 | 4/1963 | Sieger | 134/199 X |
| 3,101,730 | 8/1963 | Harris et al. | 134/167 |
| 3,117,401 | 1/1964 | Talley | 51/241 |
| 3,135,272 | 6/1964 | Brollo | 134/57 |
| 3,225,777 | 12/1965 | Shelton et al. | 134/141 |
| 3,226,277 | 12/1965 | Masuda et al. | 156/345 |
| 3,289,238 | 12/1966 | Sorenson et al. | 15/306 |
| 3,306,310 | 2/1967 | Grant | 15/88 |
| 3,324,867 | 6/1967 | Freese | 134/99 |
| 3,362,109 | 1/1968 | Wallace | 51/9 |
| 3,391,701 | 7/1968 | Richardson et al. | 134/123 |
| 3,407,099 | 10/1968 | Schell | 148/153 |
| 3,432,872 | 3/1969 | Kirschke | 15/104.12 |
| 3,439,649 | 4/1969 | Probst et al. | 118/634 |
| 3,468,362 | 9/1969 | Burkhardt et al. | 134/122 X |
| 3,698,029 | 10/1972 | Pulliam | 15/21 D |
| 3,760,824 | 9/1973 | Edwards et al. | 134/199 X |
| 3,773,059 | 11/1973 | Arneson | 134/123 |
| 3,902,513 | 9/1975 | Franz | 134/151 |
| 3,933,519 | 1/1976 | Koch et al. | 134/34 |
| 3,942,565 | 3/1976 | Ratelle et al. | 144/311 |
| 3,984,254 | 10/1976 | Alexandrov et al. | 134/56 R |
| 3,994,766 | 11/1976 | Dedels | 156/392 |
| 4,005,677 | 2/1977 | Hart | 118/307 |
| 4,007,705 | 2/1977 | Sherer et al. | 118/7 |
| 4,013,518 | 3/1977 | Miko | 202/241 |
| 4,110,862 | 9/1978 | Buzhinsky et al. | 15/88 |
| 4,125,119 | 11/1978 | Haas | 134/100 |
| 4,146,406 | 3/1979 | Sampsell | 134/167 R |
| 4,161,956 | 7/1979 | Hadgkiss | 134/167 C |
| 4,169,427 | 10/1979 | Crump et al. | 118/307 |
| 4,185,359 | 1/1980 | Niccols | 17/51 |
| 4,205,694 | 6/1980 | Thompson et al. | 134/199 X |
| 4,219,155 | 8/1980 | Goerss | 239/124 |
| 4,225,362 | 9/1980 | Sentell | 134/24 |
| 4,231,239 | 11/1980 | Lazaroff | 68/205 R |
| 4,237,817 | 12/1980 | Hart et al. | 118/307 |
| 4,237,913 | 12/1980 | Maasberg | 134/167 C |
| 4,244,524 | 1/1981 | Wellings | 239/227 |
| 4,337,784 | 7/1982 | Goerss | 134/34 |
| 4,376,443 | 3/1983 | Mondy, Jr. | 134/168 R |
| 4,443,271 | 4/1984 | Goerss | 134/34 |
| 4,445,451 | 5/1984 | van den Broek | 114/222 |
| 4,460,005 | 7/1984 | Rodger | 134/104 |
| 4,509,544 | 4/1985 | Mains, Jr. | 134/144 |
| 4,552,594 | 11/1985 | van Voskuilen et al. | 134/34 |
| 4,569,159 | 2/1986 | Wern et al. | 51/410 |
| 4,595,607 | 6/1986 | Betteridge et al. | 427/185 |
| 4,603,516 | 8/1986 | Hoffman | 51/425 |
| 4,604,770 | 8/1986 | Lang | 16/375 |
| 4,677,936 | 7/1987 | Dahlem | 118/307 |
| 4,677,998 | 7/1987 | Van Voskuilen et al. | 134/181 |
| 4,716,916 | 1/1988 | Hodge | 134/123 |
| 4,718,439 | 1/1988 | Gorra et al. | 134/57 R |
| 4,734,950 | 4/1988 | Schenke et al. | 15/88 |
| 4,788,993 | 12/1988 | Beer et al. | 134/123 |
| 4,809,720 | 3/1989 | Heraty | 134/45 |
| 4,811,902 | 3/1989 | Nagata | 239/240 |
| 4,872,294 | 10/1989 | Watts | 51/420 |
| 4,953,496 | 9/1990 | Taylor et al. | 118/72 |
| 4,989,785 | 2/1991 | Walendowski | 239/227 |
| 5,001,801 | 3/1991 | Jarvis et al. | 15/93.1 |
| 5,052,423 | 10/1991 | Chapman et al. | 134/174 |
| 5,056,271 | 10/1991 | Rose | 51/319 |
| 5,069,234 | 12/1991 | Nielsen | 134/113 |
| 5,074,323 | 12/1991 | Chapman et al. | 134/181 |
| 5,085,016 | 2/1992 | Rose | 51/129 |
| 5,091,034 | 2/1992 | Hubert | 156/344 |
| 5,092,357 | 3/1992 | Chapman et al. | 134/181 |
| 5,107,633 | 4/1992 | Rose | 51/429 |
| 5,129,355 | 7/1992 | Taylor et al. | 118/302 |
| 5,136,969 | 8/1992 | Chapman | 118/305 |
| 5,191,740 | 3/1993 | Rose | 51/429 |
| 5,199,226 | 4/1993 | Rose | 51/317 |
| 5,207,833 | 5/1993 | Hart | 118/307 |
| 5,209,245 | 5/1993 | Chapman et al. | 134/122 R |
| 5,226,973 | 7/1993 | Chapman et al. | 134/34 |
| 0214841 | 3/1987 | European Pat. Off. . | |
| 0343878 | 11/1989 | European Pat. Off. . | |
| 52-19474 | 2/1977 | Japan . | |
| 54-50158 | 4/1979 | Japan | 134/199 X |
| 59-232770 | 12/1984 | Japan . | |
| 60-121286 | 6/1985 | Japan | 134/199 |
| 8203501 | 4/1984 | Netherlands . | |
| 447499 | 3/1968 | Switzerland . | |
| 1516903 | 7/1978 | United Kingdom . | |
| 2018626 | 10/1979 | United Kingdom . | |
| 1136859 | 1/1985 | U.S.S.R. . | |
| 1276379 | 12/1986 | U.S.S.R. | 134/199 |
| 8502211 | 5/1985 | WIPO . | |
| 9111293 | 8/1991 | WIPO . | |

CLEANING OF THE EXTERIOR SURFACE OF A PIPELINE TO REMOVE COATINGS

CROSS-REFERENCE TO RELATED APPLICATIONS

This application is a continuation of our copending U.S. application Ser. No. 07/801,707, filed Dec. 2, 1991, (now U.S. Pat. No. 5,265,634 ), which is a continuation of our U.S. application Ser. No. 07/592,140, filed Oct. 3, 1990, (now U.S. Pat. No. 5,092,357), which is a continuation-in-part of U.S. application Ser. No. 486,093, filed Feb. 28, 1990, (now U.S. Pat. No. 5,074,323), which is a continuation-in-part of U.S. application Ser. No. 197,142, filed May 23, 1988, (now U.S. Pat. No. 5,052,423), which is a continuation-in-part of U.S. Application Ser. No. 055,119, filed May 28, 1987 and now abandoned.

TECHNICAL FIELD OF THE INVENTION

This invention relates generally to the cleaning of a pipeline or the like to remove coatings and miscellaneous contaminants from the pipeline exterior surface.

BACKGROUND OF THE INVENTION

Oil and gas transmission pipelines of large diameter (12"-60") are usually coated and then buried before being used for transportation of fluids. The coatings serve to reduce corrosion caused by the environment in which the pipeline operates. Various forms of coating materials have been used over the years. Coal tar products were and are well known as coating materials and, more recently, polyethylene tape layered coatings have been used.

The coating may be put on the pipe after it has been welded together in sections and before the welded line is buried. The coating process is usually continuous. In an alternate case the pipe sections are delivered to the site already shop coated except for 1'-2' on each end. A second coating is applied to cover the previously uncoated ends of each section after the welding and before the line is buried.

In recent developments several pipeline operators have experienced underground failures of old coatings. These failures are most commonly attributed to disbondments between parts of the coating and the pipe. Despite the continuous use of cathodic protection, the disbondment sites are subjected to pitting corrosion and to stress corrosion cracking (SCC) and, in severe cases, pipe failures have occurred under pressure. The situation has prompted many operators to initiate coating rehabilitation projects. Almost all SCC cases have been encountered in lines in the ground for 10 years or more.

Various devices and techniques have been developed for the purpose of facilitating the rehabilitation of a pipeline coating. The most common technique employs a self-propelled device fitted around the pipe which continuously cuts, scrapes and brushes the coating with steel knives and brushes. This method does remove some of the oldest coal tar coatings fairly well but performs unsatisfactorily on the polyethylene tape layered coatings of more recent vintage. The process leaves adhesive and tape residue. The knives utilized in this process can seriously damage the pipe surface. Devices of this type have been around for approximately 20 years.

SUMMARY OF THE INVENTION

The present invention provides an apparatus for the cleaning of the exterior surface of a pipeline or the like including a frame adapted to surround a portion of a pipeline and defining a passage of a sufficient size to permit the pipeline to extend longitudinally therethrough. Two separate cleaning units are mounted on the frame. Each cleaning unit has a plurality of jet modules mounted thereon. A jet nozzle is mounted to each jet module such that the jet nozzles can direct cleaning fluid toward the pipe so as to impact concurrently the entire circumference of the pipe. A high pressure cleaning liquid source is connected to the jet nozzles such that the jet nozzles emit a high pressure jet of cleaning liquid toward the pipeline. The jet modules mounted on the respective cleaning units are angularly shifted in order to provide optimal cleaning of the pipeline surface. The relative longitudinal motion between the frame and the pipe during the operation of the jet modules provides for the cleaning of the annular portion of the external surface of the pipe which passes through the frame.

DETAILED DESCRIPTION OF THE PREFERRED EMBODIMENT

Figure 1:
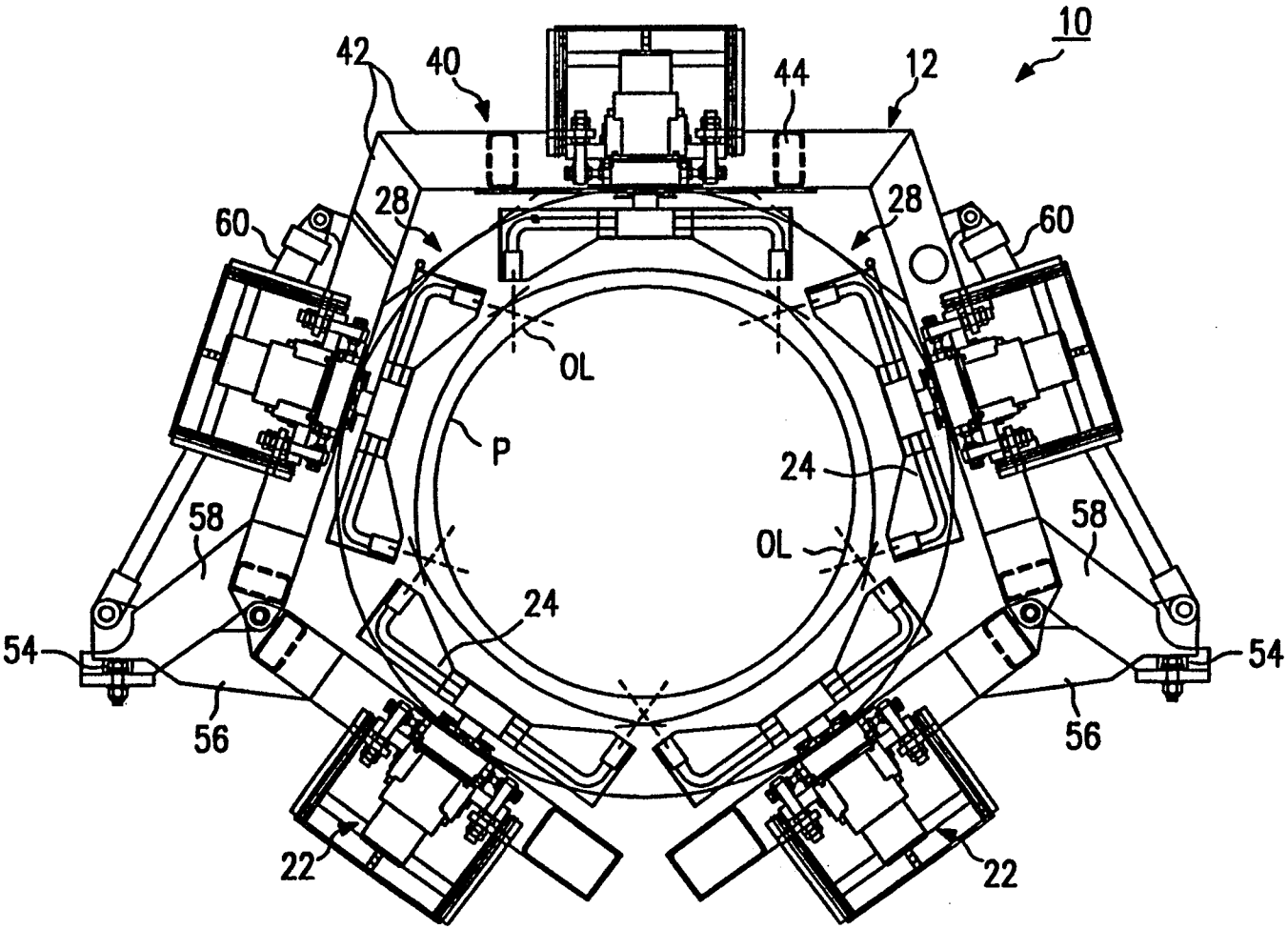
FIG. 1 is a cross-section view of a hydrocleaning apparatus according to the present invention (certain details such as the drive assemblies have been omitted)

The basic principles relating to hydrocleaning of a pipeline surface are set out in detail in our above-noted copending applications. The copending applications are incorporated herein by reference and thus the descriptions set forth in such applications need not be repeated here. The copending applications also describe the various pieces of support equipment required including the side boom tractor, pipe cradle and bridle assembly, water and hydraulic pumps, prime mover and water supply tanks etc.

Referring now to the drawings, the hydrocleaning apparatus 10 includes a frame 12 adapted to at least partially surround a portion of a pipeline P when in use. The frame 12 is supported and driven along the pipeline P by way of spaced apart fore and aft drive assemblies 14, 16 (FIGS. 2 and 3) including pairs of drive wheels 18, 20 which engage the pipeline surface to move the pipeline through apparatus 10.

A plurality of liquid jetting modules 22 are mounted to the frame 12 in circumferentially spaced relation so as to substantially surround the pipeline when in use. Each module 22 has a rotary swing arm nozzle 24 thereon, each being rotated about an axis substantially normal to the pipeline surface. In this way, nozzles 24 directs liquid jets toward the pipeline surface in a series of closely spaced overlapping convolutions during forward advance of the frame 12 relative to pipeline P. The cleaning paths thus defined by the several swing arm nozzles 24 ideally overlap somewhat at their marginal edges, as indicated by the letters OL in FIG. 1, thus helping to ensure that no uncleaned longitudinal streaks are left on the pipeline.

The jetting modules 22 are mounted to the frame 12 by respective suspension linkages 26 which allow radial motion of the modules inwardly and outwardly relative to the pipeline axis.

Each of the modules is provided with a shroud 28 (shown in section in FIG. 1 for purposes of clarity), these shrouds being disposed in an overlapping configuration all around the pipeline and the swing arm nozzles 24 to reduce escape of contaminants into the environment and for safety reasons, all as will be described in further detail hereafter.

Frame 12 is preferably constructed of sturdy tubular members welded and connected together to provide the necessary strength and rigidity. Frame 12 includes an upper frame section 40 of a generally inverted U-shape, as seen end-on, so as to surround the upper portion of the pipeline P when in use. In one embodiment, section 40 comprises three sub-sections 42 rigidly connected together by welds and including longitudinal frame elements 44 rigidly securing fore and aft frame portions together. Frame 12 also includes a pair of lower opposed frame sections 46 pivotally mounted via hinges 48 to lower opposed extremities of the upper section 40 for movement between open and closed positions. When these lower sections 46 are in the open position, the entire hydrocleaner can be lowered downwardly onto a pipeline (as described in the above-noted patent applications) and the lower frame section 46 then closed around a lower portion of the pipeline as shown in FIG. 1.

The lower frame sections 46 each comprise a pair of independently pivotable frame portions 50, 52 (FIG. 3) each of rigid triangular outline configuration. The first frame portions 50 are pivotable from the open position into a predetermined or fixed closed position relative to the upper frame section 40 about their hinges 48. The predetermined closed position is shown in FIG. 1, such closed position being provided by adjustable hinge stops 54 co-acting between a rigid extension arm 56 fixed to each frame portion 50 and a bracket 58 fixed to the lower portions of the upper frame section 40. The adjustable stop 54 may comprise a threaded stud and lock nut configuration well known as such.

Each first frame portions 50 has a respective water jetting module 22 mounted therein via a respective parallel arm suspension linkage 26 to be described in detail below. When frame portions 50 are in the predetermined closed positions against stops 54, the rotation axes of the respective swing arm nozzles 24 (including those mounted to the upper frame section) all pass substantially through the axis of the pipeline and this condition is maintained regardless of out of round pipeline and other irregularities as noted previously. Hence, a shorter swing arm length can be used while still providing the desired amount of overlap OL of the cleaning paths provided. For example it was found that five swing arms could be used around pipe as small as 16 inches OD without the risk of the swing arms touching each other when set at normal stand-off distances. Streaking problems and side stand-off distance variations were greatly reduced.

The second frame portions 52 serve to mount respective idler wheels 58 (FIG. 2) which engage the pipeline surface at locations generally opposed to the locations where the drive wheels 18, 20 (which are mounted to the upper frame section) engage the pipeline. The idler wheels may, if desired, be replaced with further sets of drive wheels and associated drive assemblies to provide extra tractive force. Multi-hole mounting plates 60 provide the necessary radial adjustability to accommodate a wide variety of pipeline diameters.

Figure 2:
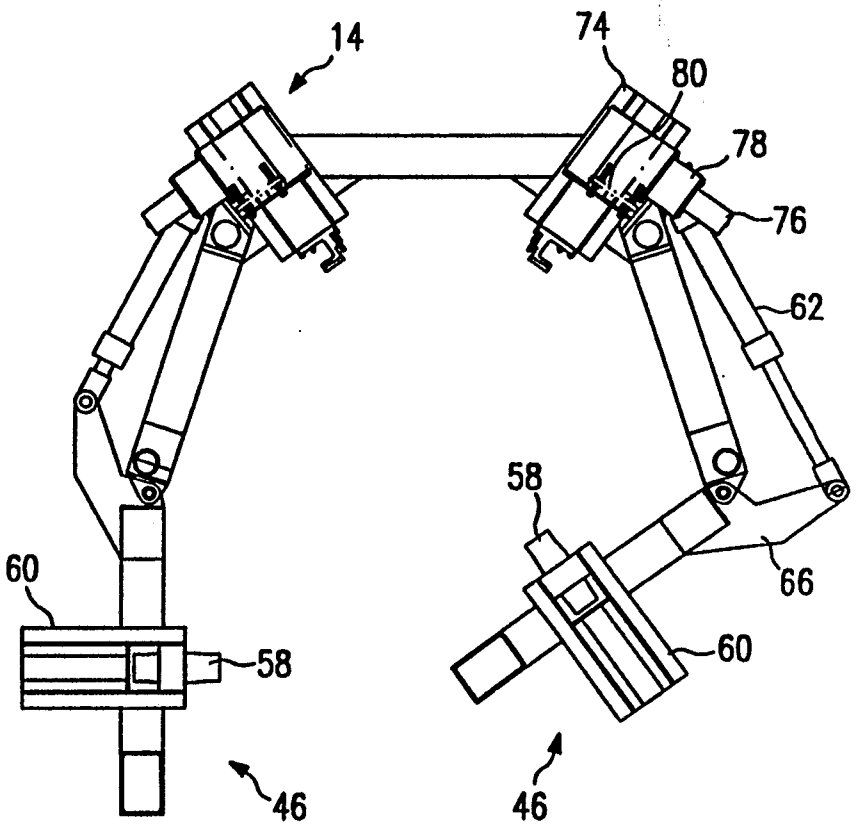
FIG. 2 is a front end elevation view of the frame assembly and drive (the liquid jetting modules and their suspension linkages have been omitted)
Figure 3:
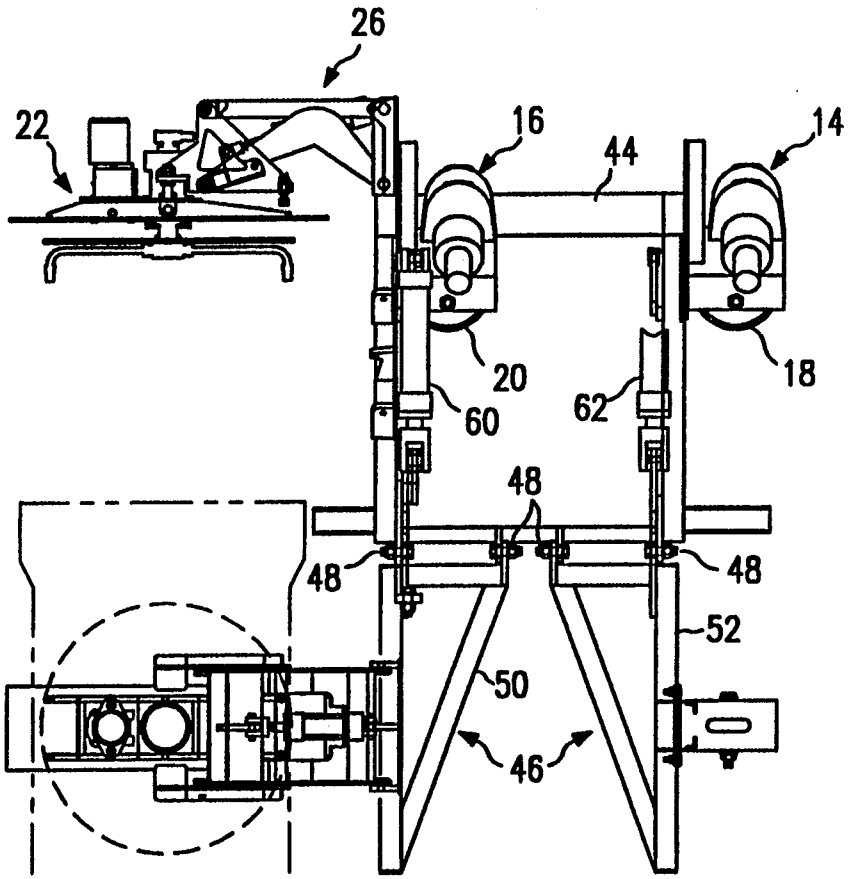
FIG. 3 is a side elevation view of the hydrocleaning apparatus (several of the liquid jetting modules and their suspension linkages and shrouds have been omitted)

The frame portions 50, 52 are each provided with their own hydraulic actuators 60, 62 respectively, each of which acts between a respective lug fixed to the upper frame section 40 and an associated extension arm fixed to the frame portion 50, 52. Actuators 60 for the first frame portions 50 (to which the lower modules 22 are mounted) are secured to the above-noted extension arms 56 while actuators 62 for the second frame portions 52 (to which the idler wheels 58 are mounted) are secured to similar extension arms 66 (FIG. 2).

All of the actuators are supplied via a common hydraulic supply and control circuit 68 (FIG. 14) of a conventional nature having a pre-charged pressure accumulator 70 therein. Hence, when the lower frame sections are closed, the first frame portions 50 are brought into the pre-set positions against the stops 54 while the second frame portions 52 are resiliently biased inwardly as a result of the action of the accumulator to bring the idler wheels into tight engagement with the pipeline surface thereby to enhance the tractive force the drive wheels 18, 20 are capable of supplying. As the idler wheels 58 encounter pipeline irregularities of the type noted previously, the second frame portions 52 are free to pivot inwardly or outwardly. However, since the first frame portions 50 remain in their fixed positions against the stops 54, the relative orientations of the suspension linkages 26 for the water jetting modules are in no way affected by these motions of the frame portions 52 as the idler wheels follow irregularities in the pipeline surface.

The above-noted front and rear drive assemblies 14, 16 need not be described in detail. They are mounted to the upper frame section 40 by way of multi-hole brackets 74 permitting substantial radial adjustment to accommodate a wide variety of pipe sizes as noted in our prior patent applications. Each drive assembly includes a hydraulic motor 76 which is connected to a reduction gear box 78, the output of the latter being conveyed to the associated drive wheel 18, 20 via a chain and sprocket drive 80. The hydraulic supply and control system for the wheel drive motors 76 is shown in FIG. 14 and includes main control valve 82 with on-off, reverse and forward functions and the usual overpressure relief and safety valves, none of which need be described in detail.

Referring to FIGS. 4–7, one of the modules 22 is shown in partial cross-section. Reference may be had to our above-noted patent applications, incorporated herein by reference, for details of the structure. The rotary swing arm assembly 24 is mounted to the output shaft 84 of a commercially available rotary swivel assembly 90 which is mounted to the module frame 91 and connected to the high pressure hydrocleaning liquid source (e.g. 20,000 to 35,000 psi) by supply lines (not shown). The swivel 90 is driven in rotation at a suitable speed (e.g. 1000 RPM depending on rate of advance and other factors as outlined in our prior patent applications) by way of hydraulic motor 92 and intermediate gear drive box 94. The high pressure hydrocleaning liquid passes axially through the shaft 84 and thence along the swing arms 96 and through the jet nozzles 98 at the tips of the arms, all as described in our earlier patent applications.

The previously noted suspension linkage 26 for mounting each module 22 to the frame 12 of the machine will be described in further detail. Essentially, the linkage ensures that the module can move in and out in a radial direction while the swing arm axis is maintained in substantial alignment with the pipeline axis. Thus each linkage 26 preferably comprises a parallel arm linkage including upper and lower rigid control arms 100, 102. The forward ends of arms 100, 102 are pivotally mounted at spaced pivot points 104, 106 to a multi-hole adjustment bracket 108 which in turn is secured to the machine frame (the multiple holes accommodate adjustments necessitated by a wide variety of pipe sizes). The trailing ends of arms 100, 102 are pivotally attached at spaced pivot points 108, 110 to an end link 112, the latter having a somewhat triangular configuration as seen side-on. A hydraulic cylinder 114 extends from a lug on adjustment bracket 108 to a lug 116 near the trailing end of the lower control arm 102. As cylinder 114 is advanced and retracted the parallel arm linkage is moved radially inwardly and outwardly relative to the pipeline surface along with the module 22 fixed thereto.

Figure 14:
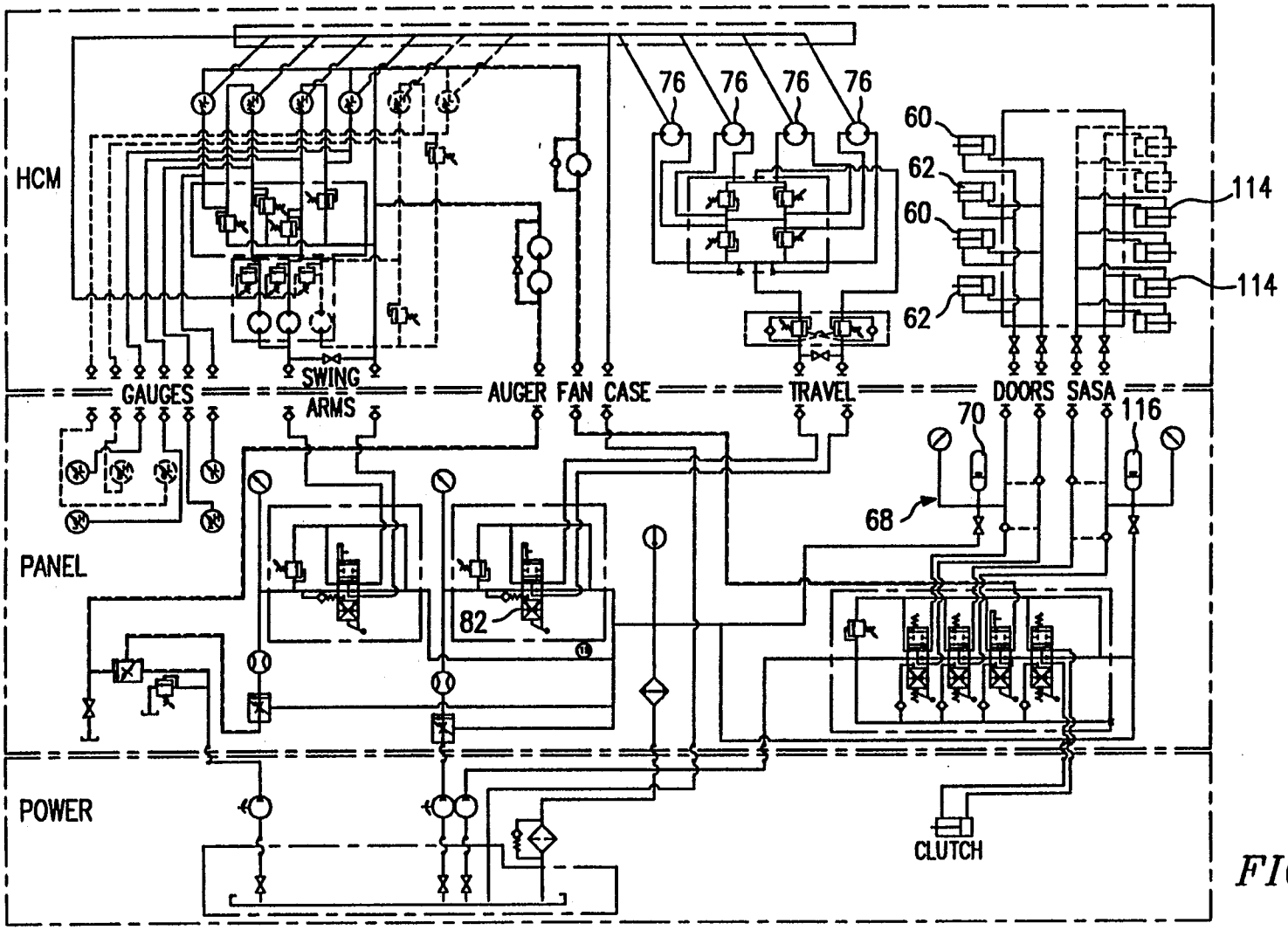
FIG. 14 is a schematic of the hydraulic system.

The control valves and hydraulic circuit for all the hydraulic cylinders 114 are shown in FIG. 14. The hydraulic circuit includes a pressurized accumulator 116 which acts to cause each cylinder to bias its associated linkage and attached module toward the pipeline surface when the equipment is in use.

The above-noted end link 112 of the suspension linkage 26 is connected to the module 22 by a pivot assembly 120 defining a transverse pivot axis passing through the rotation axis of the swing arm assembly 24. Pivot assembly 120 includes a laterally spaced pair of eye bolts 122, each mounted in a respective flange 124 fixed to the end link 112. Transverse studs 126 pass through the "eyes" of these eye bolts 122 and into the frame 91 of the module 22. By adjusting the adjustment nuts 128 on the eye bolts, the swing arm rotation axis orientation can be adjusted in a plane transverse to the pipeline axis and passing through the pivot axis defined by the eye bolts. This enables the nozzle side standoff distances (see our prior application for details) to be adjusted and equalized.

With the pivot arrangement just described, the module 22 is free to pitch about the above-noted pivot axis during operation. It will of course be noted that each module includes fore and aft guide and support wheels 130, 132 for supporting the module on the pipeline surface. When the module 22 is entirely free to pitch about the above-described pivot axis, both of these guide wheels 130, 132 will be in contact with the pipeline surface at all times. In cases where thick coatings are being removed, the forward guide wheel 130 can ride up on the coating while the other guide wheel 132 rides on the cleaned pipeline surface. The whole module pitches to and fro to the extent needed to accommodate the changes in coating thickness encountered as well as any other surface irregularities. This helps to ensure that the minimum standoff distances (e.g. about ½ inch) at the fore and aft nozzle passes remain substantially equal regardless of coating thickness.

Figure 4:
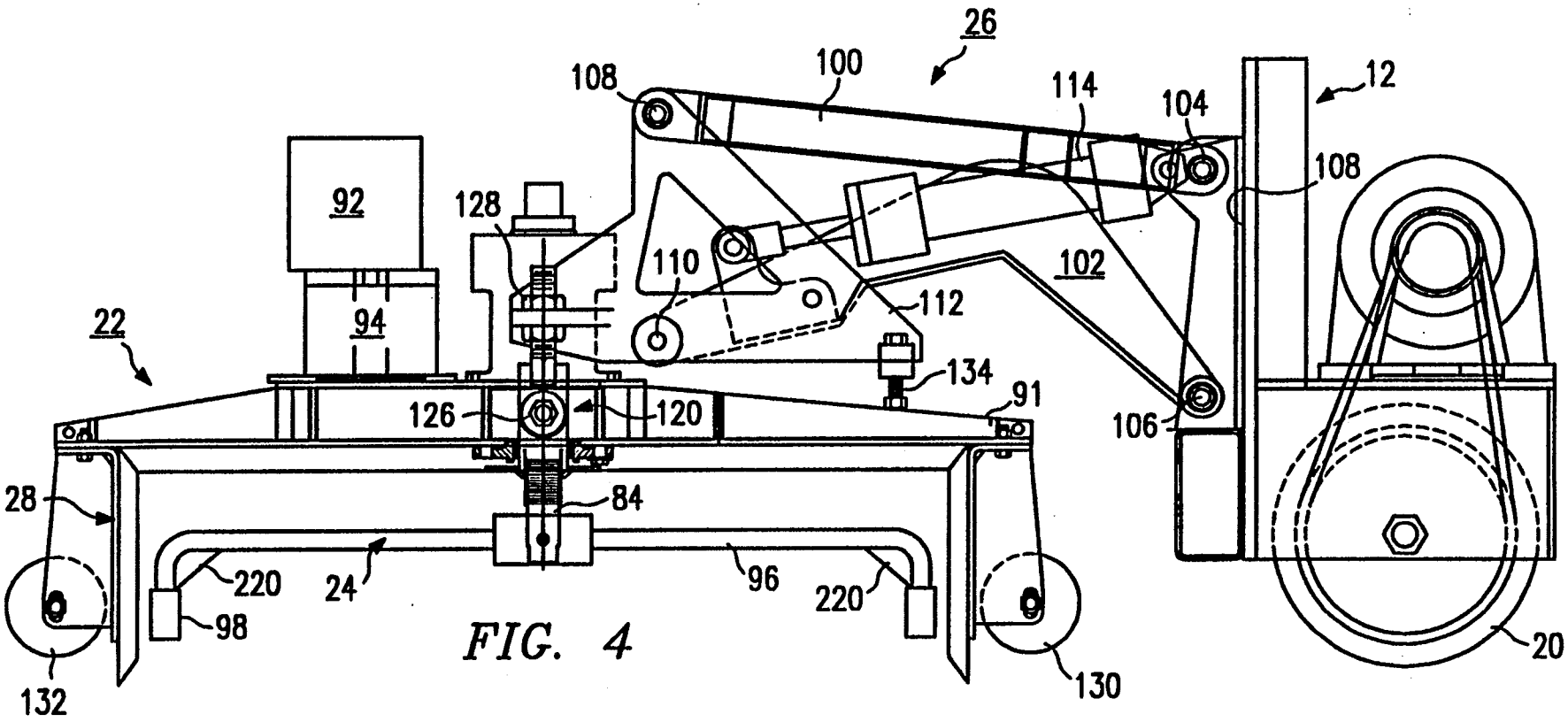
FIG. 4 is a side elevation view of a liquid jetting module and its suspension linkage.
Figure 5:
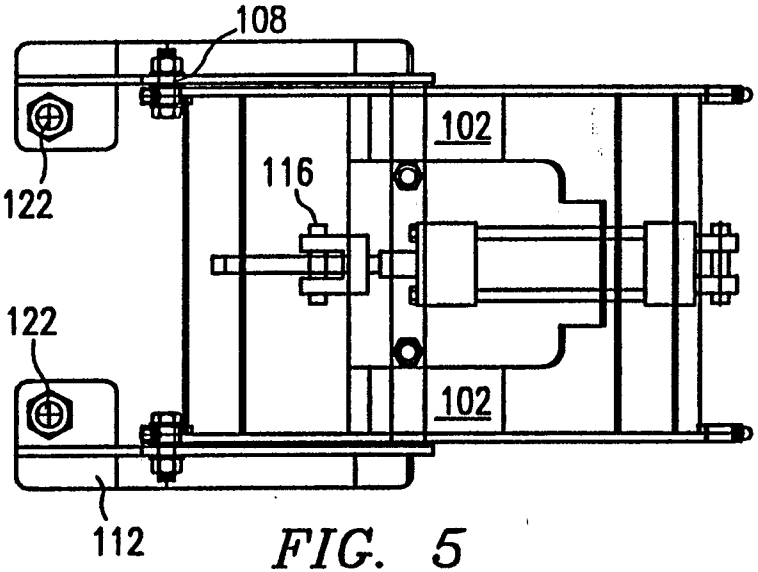
FIGS. 5, 6, and 7 are top, side, and top views, respectively, of various components of the module suspension linkage.
Figure 7:
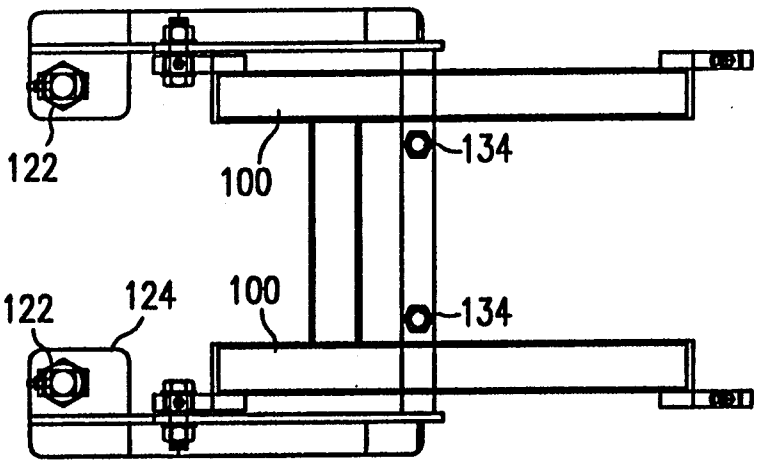
Figure 6:
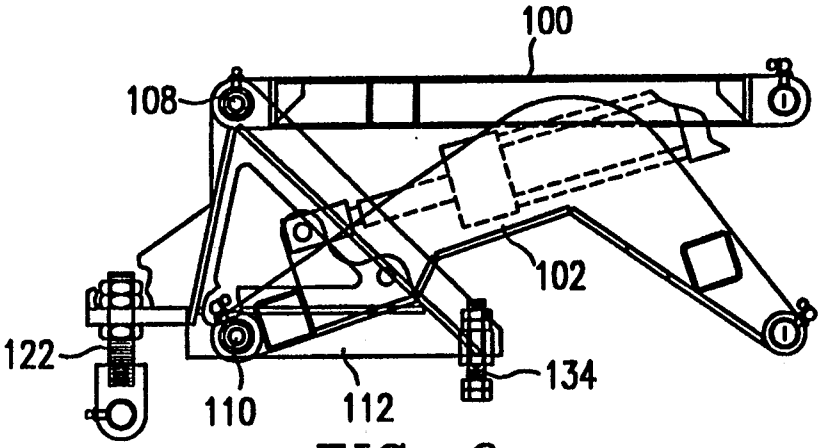

However, there are other situations, as where one is dealing with fairly thin coatings, where one wishes to keep the module parallel to the pipeline axis at all times and the rear guide wheel 132 clear of the pipeline surface as to prevent "tabbing" down of removed coating materials onto the pipeline surface by the action of this guide wheel. Therefore, in order to enable the module 22 to be effectively locked to prevent the pitching motion referred to, the end link 112 is provided with adjustable stops 134 in the form of studs which are rotated outwardly until they touch the top of the module frame as best seen in FIG. 4. When this has been done, only the forward guide wheel 130 contacts the pipeline surface.

Figure 13A:
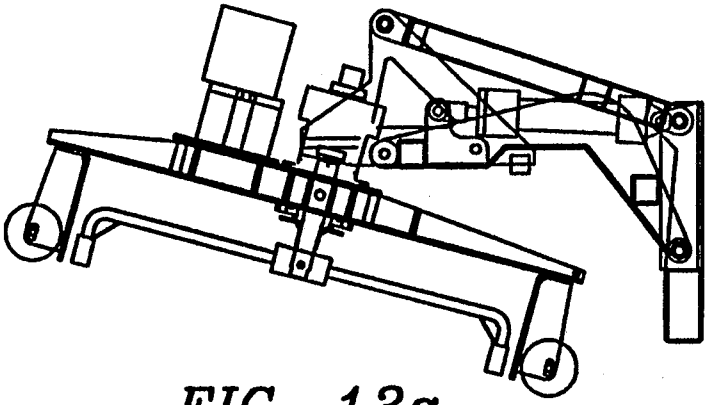
FIGS. 13A and 13B are side elevation views of a module and its suspension linkage showing the module at various pitch angles relative to the pipeline surface.
Figure 13B:
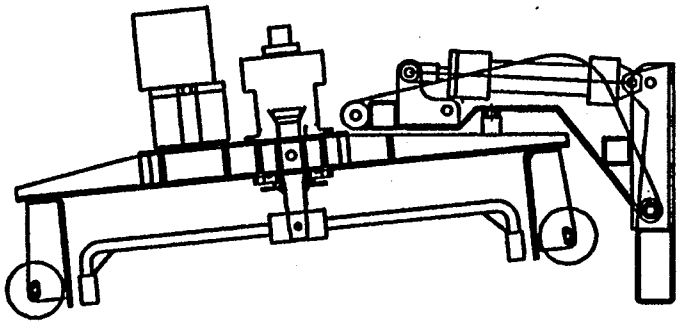

Another advantage associated with the module pivot axis arrangement noted is that any module 22 can be tilted forwardly or rearwardly (see FIGS. 13A and 13B for example) thereby to permit the swing arm nozzles to be inspected and repaired fairly readily.

In a preferred embodiment of the present invention, modules 22 are positioned rearwardly of the frame 12 of the machine in what might be termed a cantilever fashion and rearwardly of the fore and aft sets of drive wheels 18, 20. As noted previously, this is advantageous since the drive wheels cannot contact the cleaned pipeline surface and act to tamp down pieces of removed tape, adhesive and other debris onto the cleaned surface, reference being had to the earlier discussion regarding "tabbing" of the pipeline surface. When the rear module guide wheel 132 is held clear of the pipe surface by the adjustable stops 134 described previously, the tabbing problem should be substantially overcome.

It has been found that it is desirable to include additional sets of jetting modules 22 in order to provide for greater cleaning of the pipeline surface. Thus, in another preferred embodiment of the present invention, two sets of modules 22 are mounted on frame 12. Each set of modules 22 is mounted to frame 12 through a cantilever arm attachment. The first set of modules 22A is mounted forwardly of the drive wheels 18, 20, and the second set of modules 22B is mounted rearwardly of the drive wheels 18, 20. It will be appreciated that the second set of modules 22B trail the drive wheels 18, 20 in this embodiment in the same way that module 22 trailed drive wheels 18, 20 in the embodiment discussed above. In this way, it is possible to mount two or more sets of modules on frame 12 without causing pieces of removed tape, adhesive and other debris to be tamped onto the pipe P, as discussed above.

Figure 24:
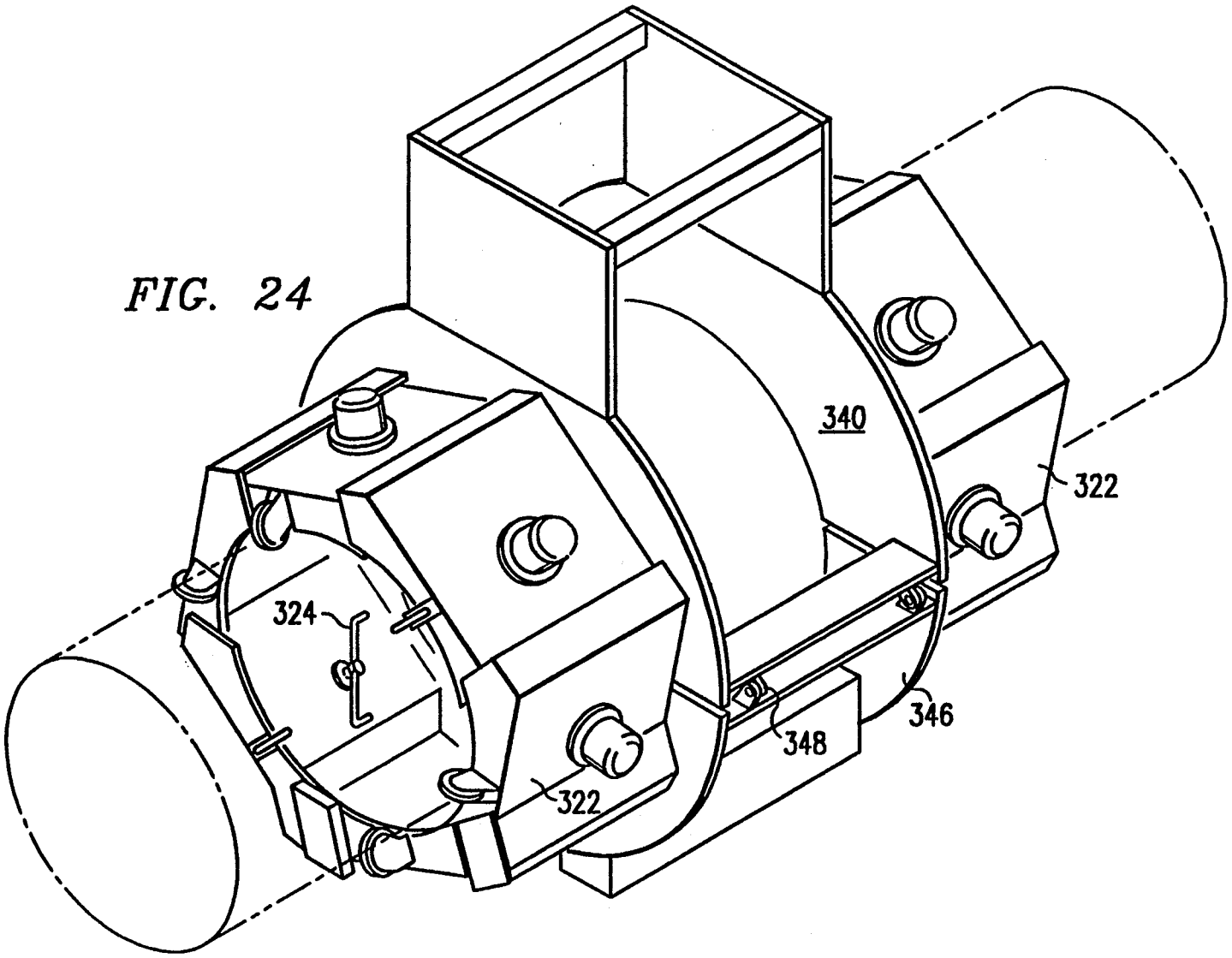
FIG. 24 is a plan view of a preferred embodiment of the present invention in place on a pipe.
Figure 25:
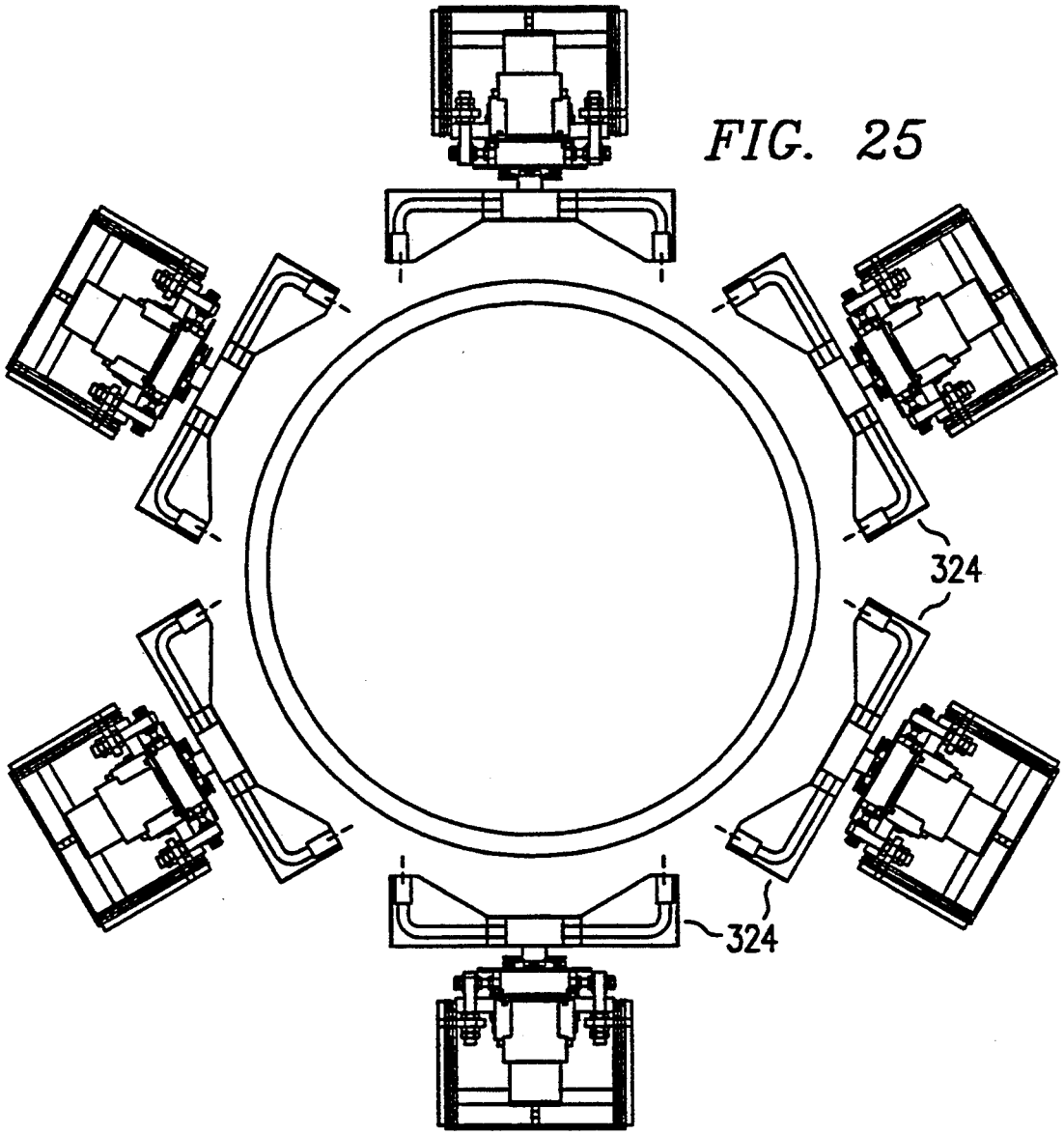
FIG. 25 is a schematic view of the orientation of the jet modules in one embodiment of the present invention.

In the preferred embodiment depicted in FIGS. 20–25, each set of modules has six modules 322 disposed substantially equal intervals in a circular array about the circumference of pipe P. In this embodiment, each module 322 directs high pressure hydrocleaning liquid through nozzles to at least 60° of the circumference of pipe P. In order to provide an optimal cleaning effect through the use of two sets of modules 322, the second set of modules is preferably angularly rotated 30° about the axis of pipe P relative to the first set of modules to produce a phase differential of one-half the target area. In order to effect the desired angular offset of the first and second sets of modules, the first set of modules is rotated 15° clockwise from vertical and the second set of modules is rotated 15° counter-clockwise from vertical. This angular rotation is depicted in FIG. 24. In order to effect this angular offset, it is necessary that three modules be mounted on upper frame section 340 and that three modules be mounted on lower frame section 346. It will be apparent that the clockwise and counter-clockwise rotation of the modules discussed above will result in two modules being mounted on one of the lower frame section 346 and one module being mounted on the other lower frame section 346.

As a result of the angular offset of the modules in this preferred embodiment, the cleaning effect depicted in FIGS. 16–19 is realized. It is to be appreciated that any phase difference between the first and second set of modules 322 will produce an enhanced cleaning effect. However, a phase differential of approximately one-half of the target area has been found to provide the desired cleaning effect. It is also to be appreciated that additional sets of modules can be mounted on frame 312 utilizing the same phase shifting approach in order to obtain further enhanced cleaning of pipe P.

Figure 21:
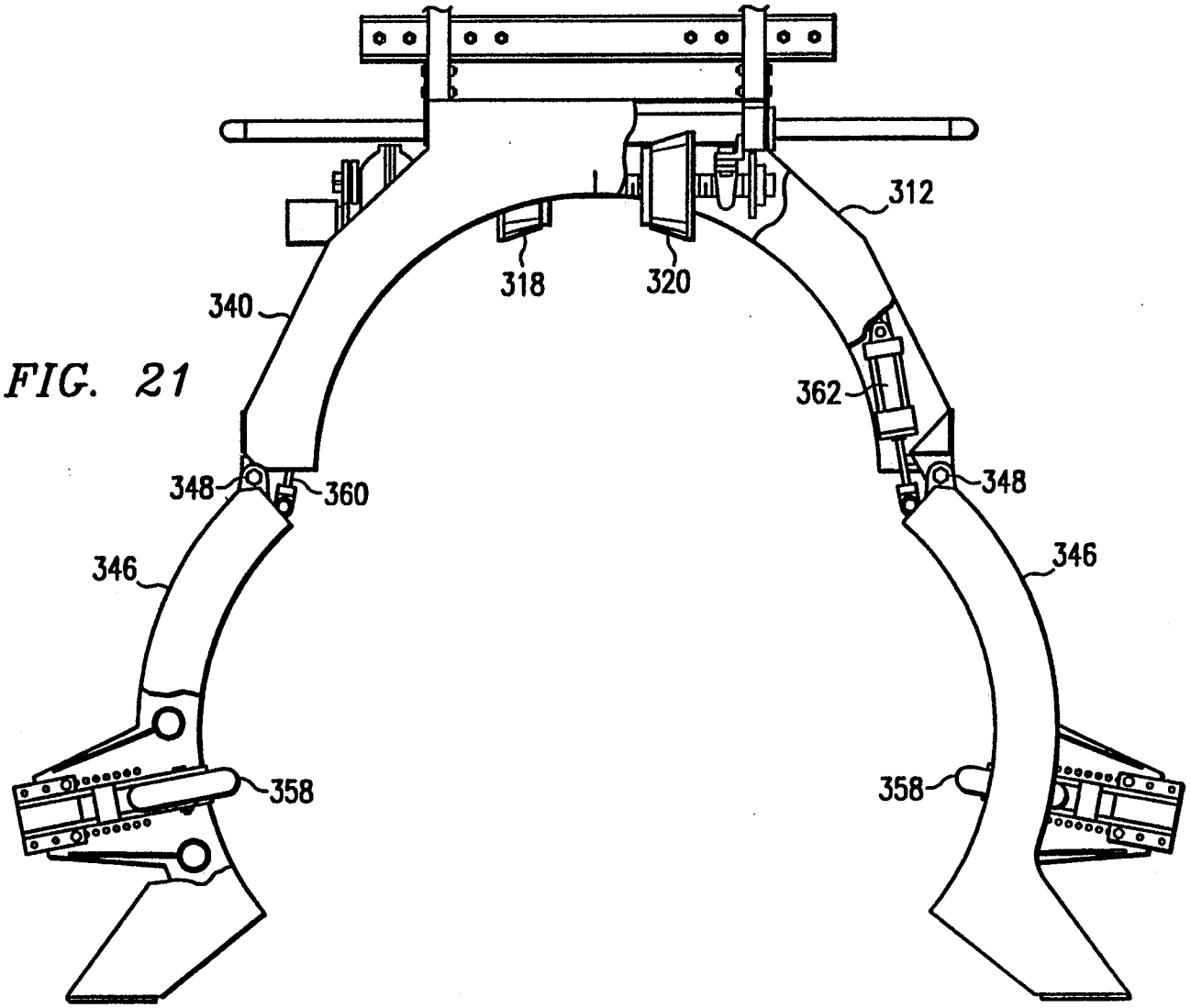
FIG. 21 is an end view of a preferred embodiment of the frame of the present invention in its open position.
Figure 22:
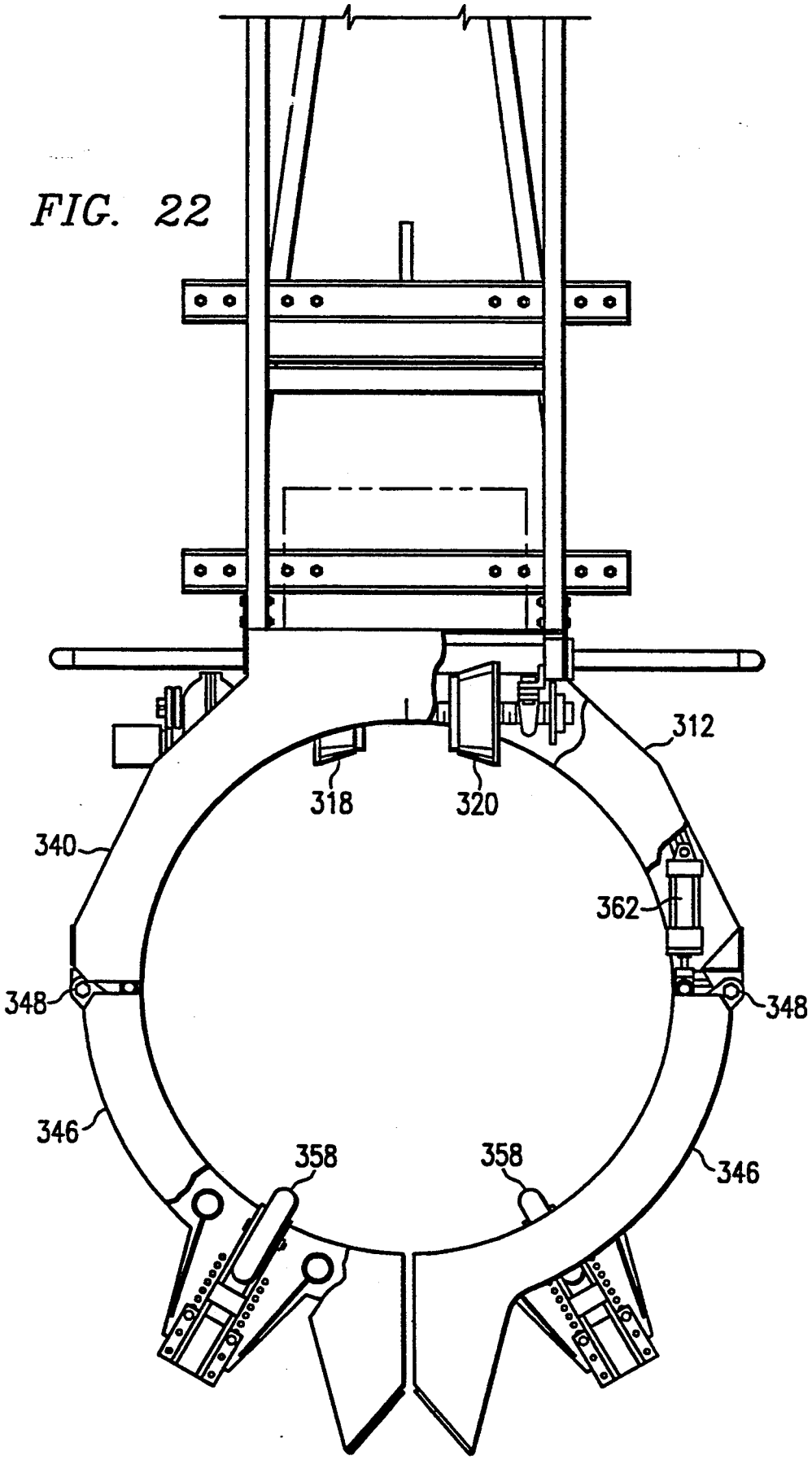
FIG. 22 is an end view of a preferred embodiment of the frame of the present invention in its closed position.
Figure 23:
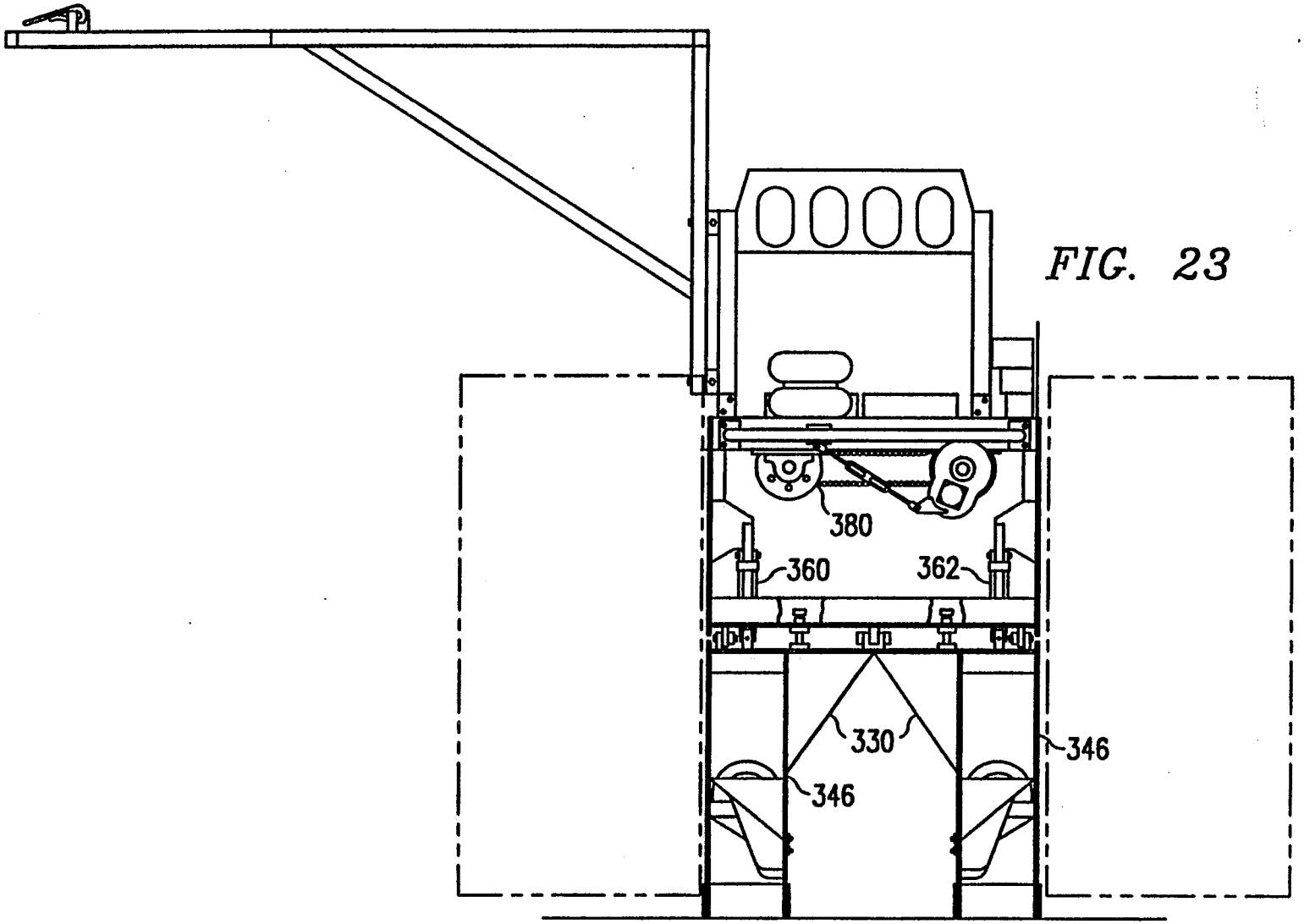
FIG. 23 is a side view of a preferred embodiment of the present invention.

FIGS. 21 and 22 depict frame 312 of a preferred embodiment of the present invention. In FIG. 21, frame 312 is in its open position whereby frame 312 can be lowered into place over an in situ pipe P. Frame 312 includes an upper frame section 340 and two lower frame sections 346. Lower frame section 346 include gussets 330 in order to provide additional structural strength and rigidity to lower frame section 346. Lower frame sections are pivotally mounted on upper frame section 340 through hinges 348. Hydraulic actuators 360, 362 are mounted across hinges 348 in the manner depicted in FIG. 21. Upon activation of hydraulic actuators 360, 362, lower frame sections 346 are drawn inwardly until frame 312 reaches its closed position as depicted in FIG. 22. Drive wheels 318, 320 and idler wheels 358 are also provided on frame 312 as set forth above. When frame 312 is in its closed position, hydraulic actuators 360, 362 continue to apply a closing force on lower frame section 346 relative to upper frame section 340, thereby urging idler wheels 358 into tight engagement with pipe P. It is to be appreciated that lower frame sections 346 are free to move about hinges 348 as frame 312 encounters surface irregularities along pipe P. Lower frame section 346 will move in response to pipeline irregularities due to the interaction of idler wheels 358 with the surface of pipe P.

Figure 9:
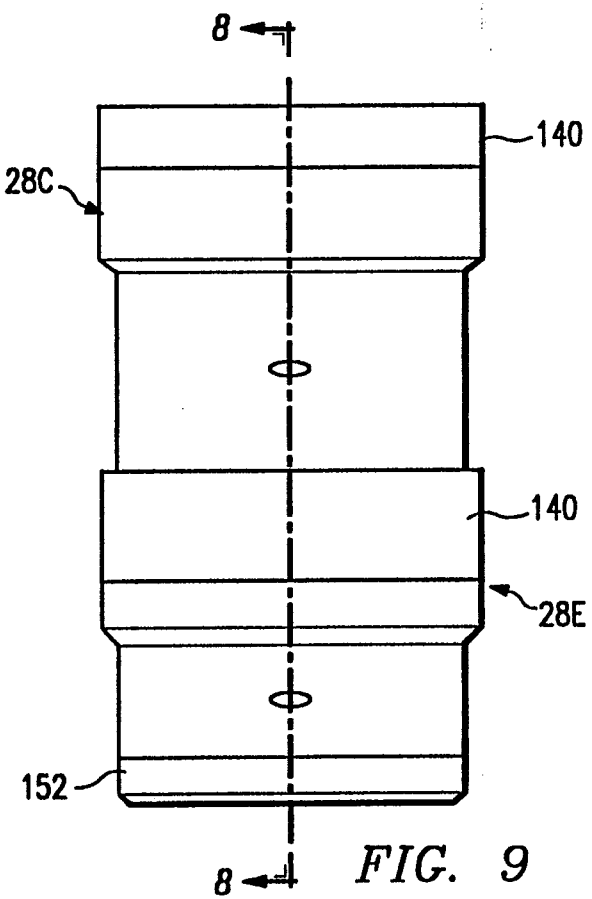
FIGS. 8 and 9 are section and side elevation views, respectively, of the overall shroud assembly with shrouds in their overlapping relationship (the swing arms being shown in phantom and the rest of the machine having been omitted)
Figure 8:
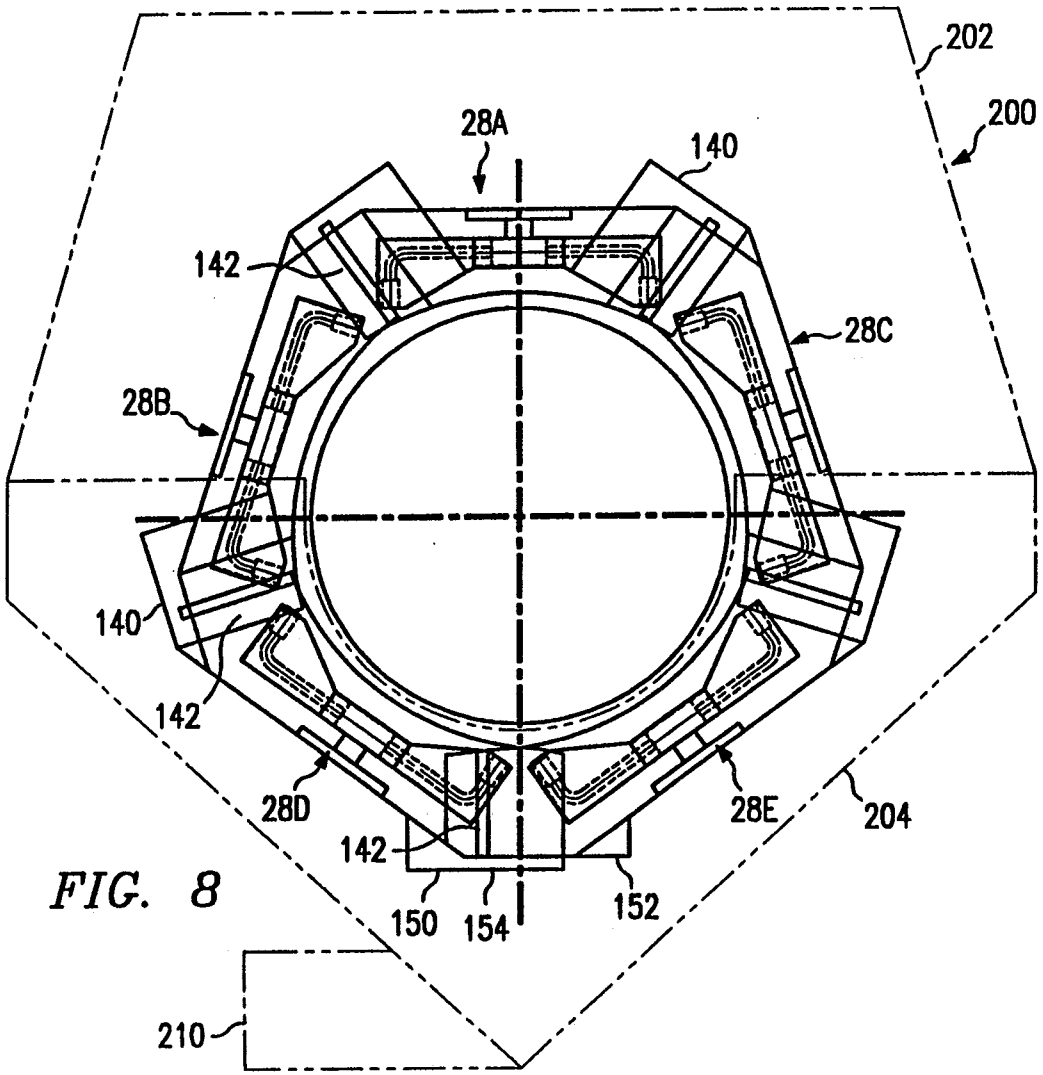

The need for a protective shrouding was discussed previously and the shrouds 28 were noted briefly in connection with FIG. 1. With reference now to FIG. 8–12, the shroud assembly is shown in further detail. Each module 22 includes its own shroud rigidly fixed thereto and the shrouds of the adjacent modules are shown in FIGS. 1, 8 and 9 as defining an overlapping annular array fully enclosing the swing arm nozzle assemblies 24 all around the outside of the pipeline. A substantial degree of overlap between adjacent shrouds is provided by the angled shroud overlap wings 140. The overlapping relationship between adjacent shrouds allows for substantial radial motions of the modules and their shrouds relative to one another while at the same time preventing the formation of substantial gaps between the shrouds. Also, resilient sealing flaps 142 extend between the overlap portions of adjacent shrouds to further inhibit the escape of liquid and debris.

Figure 10:
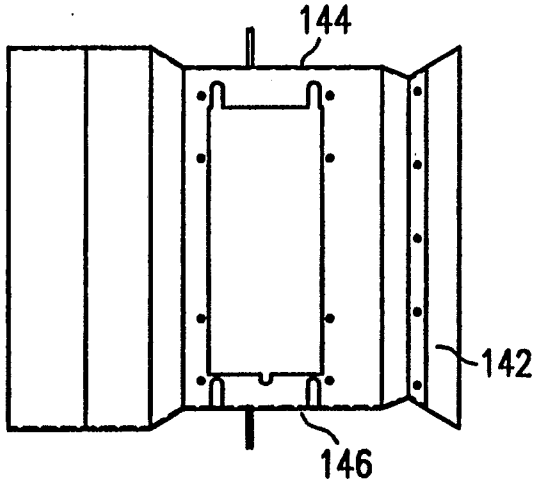
FIGS. 10, 11, and 12 are plan, end elevation, and side elevation views, respectively, of a shroud.
Figure 11:
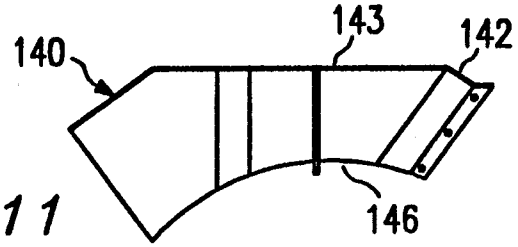
Figure 12:
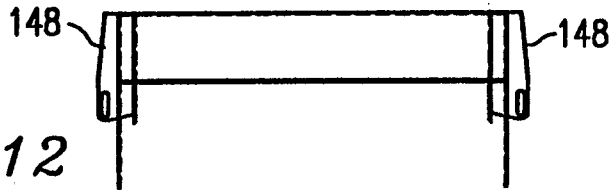

One shroud is shown in detail in FIGS. 10–12. The shroud includes a flat top wall 143 which is bolted on to the frame 91 of the module (FIG. 4). The fore and aft end walls 144, 146 extend normal to top wall 143 and in use project inwardly into close proximity to the pipeline surface. The free edges of these walls are curved to match the pipeline surface contour. These end walls also include mounting brackets 148 for mounting the above-noted fore and aft module guide wheels 130, 132. The overlap wing 140 is angled relative to the intermediate section of the shroud and is of somewhat greater dimension in the lengthwise (travel) direction than the intermediate shroud section thereby to accommodate the next adjacent shroud without interference. The opposing side of the shroud is also angled inwardly and provided with a flared marginal portion to which is connected a resilient flap 142, the flap extending all along the free edge of that side of the shroud. When the shrouds are in their overlapping configuration, the flap 142 contacts the interior of the overlap wing 140 of the next adjacent shroud.

As will be seen from FIG. 8, the shrouds are somewhat different from one another depending on their locations. The uppermost shroud 28A, being overlapped on both sides by the overlap wings of shrouds 28B and 28C, does not have an overlap wing at all but is provided with a sealing flap 142 on both of its sides to effect sealing engagement with shrouds 28B and 28C. The lowermost shrouds 28D and 28E differ from shrouds 28B and C by the inclusion, at their lower ends, of an enlarged collector portion 150, 152 shaped to form a recess or sump when the shrouds are fitted together which receives the downwardly draining liquids and debris. A suitable opening 154 allows this material to escape into a suitable collector.

As noted previously, modules 22 and their suspension linkages 26 are each provided with a hydraulic actuator 114 to move the modules 22 including their shrouds 28 toward and away from the pipeline surface. In order to prevent interference between adjacent shrouds 28 during such radial movement, time delays are incorporated into certain of the hydraulic lines to the actuators 114 to achieve the desired result. The preferred way of avoiding interference is to move the modules and attached shrouds inwardly in the time sequence in which they naturally move under gravity. For example, starting with all modules "out", the top (12 o'clock) module 28A will fall first, then the 10 and 2 o'clock modules 28B and C will fall simultaneously and finally the modules 28D and E at the 8 and 4 o'clock positions will rise simultaneously. An orifice is fitted into the flow circuit of the actuator for the 4 o'clock position, module 28E, so that it rises into position after the 8 o'clock module 28D is in place thereby avoiding interference. When "opening+ up the modules, the above sequence is reversed.

As noted previously, many of the coatings that are to be removed from pipe contain hazardous materials, such as asbestos. Because of the degradation of the coating on the pipe being repaired, the asbestos is frequently in a friable condition, prone to ready disbursal of small fibers into the surrounding air space. Clearly, such contamination must be kept to a minimum.

The use of shrouds 28 is useful in containing such contamination. However, the use of a shroud assembly 200, which completely envelops the modules 22 and frame 12, and allows for the maintenance of a relative vacuum or negative pressure within the interior of the shroud assembly, is believed to be the most efficient mechanism to contain such contamination.

Figure 15:
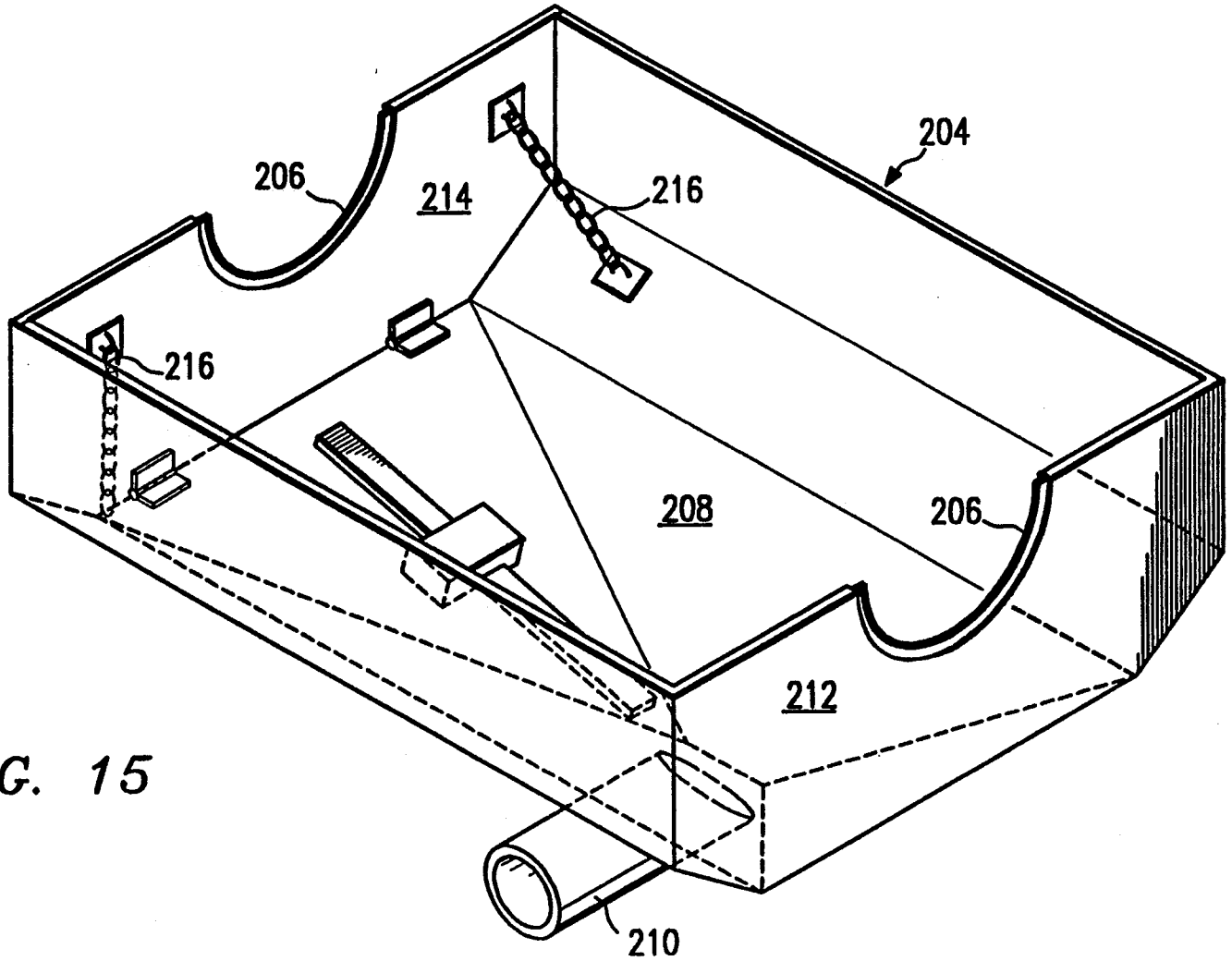
FIG. 15 is a perspective view of a collection pan for use when removing coatings having hazardous materials.
Figure 16A:
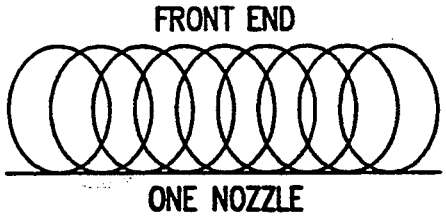
FIG. 16A is a X-Y plot of the path of a selected jet nozzle mounted on the front end of a hydrocleaning apparatus according to the present invention.
Figure 16B:
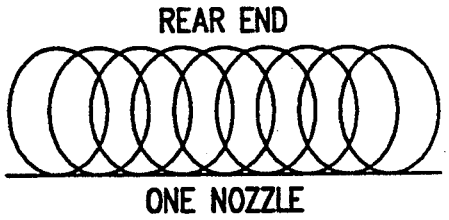
FIG. 16B is an X-Y plot of the path of a selected jet nozzle mounted on the rear end of a hydrocleaning apparatus according to the present invention.
Figure 17:
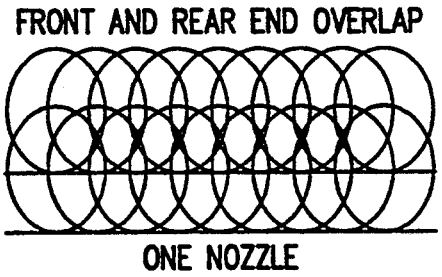
FIG. 17 is a composite X-Y plot of the paths of select jet nozzles mounted according to the present invention.
Figure 18A:
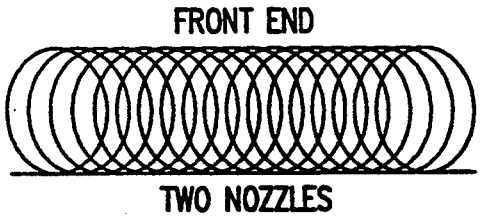
FIG. 18A is an X-Y plot of the paths of jet liquid emitted by a module mounted on the front end of an apparatus according to the present invention wherein each jet module has two jet nozzles mounted thereon.
Figure 18B:
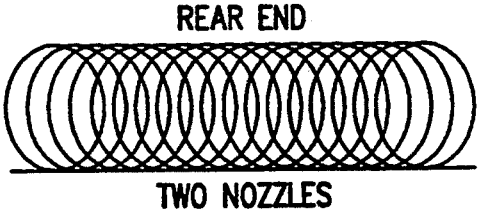
FIG. 18B is an X-Y plot of the paths of jet liquid emitted by an module mounted on the rear end of an apparatus according to the present invention wherein each jet module has two jet nozzles mounted thereon.
Figure 19:
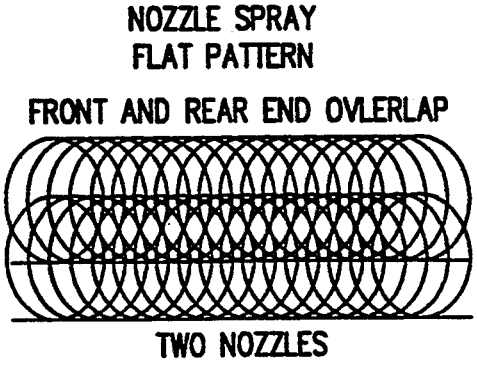
FIG. 19 is a composite X-Y plot of the paths of jet liquid emitted by jet modules mounted according to the present invention wherein each jet module has two jet nozzles mounted thereon.
Figures 20A, 20B, 20C:
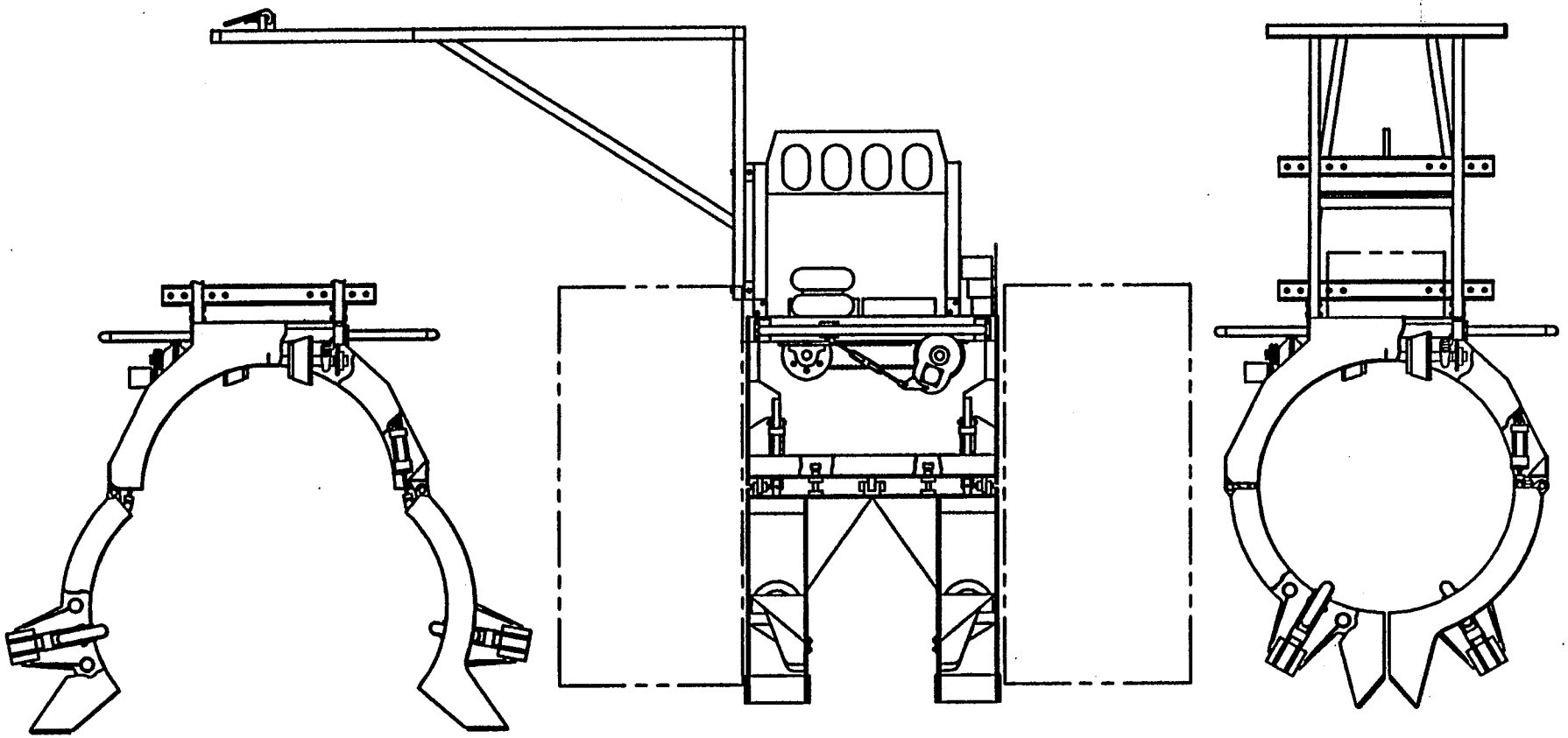
FIG. 20A is an end view of a preferred embodiment of the frame of the present invention in its open position.
FIG. 20B is a side view of a preferred embodiment of the present invention.
FIG. 20C is an end view of a preferred embodiment of the frame of the present invention in its closed position.

With references to FIGS. 8 and 15, the shroud assembly 200 can be seen in better detail. The shroud assembly 200 includes two sections, a top shroud 202 and a collection pan 204. By forming shroud assembly 200 in two pieces, the assembly can easily be installed about the modules 22 and frame 12 when on the pipeline. When installed, the top shroud 202 and collection pan 204 are secured together in a relatively airtight manner at their mating edges. Both the top shroud 202 and collection pan 204 have hemispherical openings at their ends on which are mounted flexible seal elements 206. When the top shroud 202 and collection pan 204 are secured together, the atmospherical openings align to form a cylindrical opening for passage of the pipe. The seals 206 provide a relative airtight seal to isolate the interior of the shroud assembly 200.

With reference specifically to FIG. 15, the details of the collection pan 204 can be better seen. The collection pan 204 has a doubly sloping bottom 208 which acts to concentrate all debris and contaminants at the lowest point of the bottom 208 at the opening of a suction fitting 210. A vibrator 220, acting through a bar 222 on the bottom 208, induces vibrations to assist in moving the debris downward to the suction fitting 210. The suction fitting 210 can be connected to a suction hose from a vacuum cleaning device which literally sucks out the debris and contaminants within the interior of the shroud assembly 200 as the pipe is being cleaned to safely dispose of the contaminants.

To make the installation of the collection pan 204 simpler, the end panels 212 and 214 on the pan 204 can be hinged to the bottom 208. When installed about the modules 22 and frame 12, the end panels 212 and 214 are held in place by chains 216. However, the chains 216 can be released and the end panels pivoted down about their hinges to facilitate either installation or removal of the pan.

During tests of the efficacy of an apparatus designed in accordance with teachings of the present invention on certain pipe coatings, specifically polyethylene tape, it was found that the particular cleaning action of the rotating swing arm nozzles 24 would tend to shred the tape and force the tape into the inner bend of the nozzles where it turns again along the axis of rotation of the nozzles to end in the nozzles themselves. The tape debris could be caught and wrapped about the arm in this inner bend to the point where it would affect the efficiency of the nozzles, and possibly even prevent them from rotating as designed. A solution to this problem was found by installing paddles 220 across the inner bend on the nozzles 22 as seen in FIG. 4. The paddles shown cut across the inner bend at an angle of 45°, although it is clear that other angles may be utilized. Further, the inner edge of the paddle may be curved, rather than straight as shown, which would be expected to have even a more enhanced ability to deflect debris off the nozzle.

The manner of operation of the hydrocleaner described above will be readily apparent to those skilled in this art on review of this disclosure and the disclosures contained in our previous patent applications. Numerous variations and modifications will readily occur to those skilled in this art upon reading the above description, and without departing from the spirit or scope of the invention. For definitions of the invention reference is to be had to the appended claims.

What is claimed is:

1. Apparatus for treating an exterior surface of a pipe, wherein said pipe has a longitudinal axis, said apparatus comprising:

a frame suitable for being positioned on said pipe, said frame having a first end and a second end, said frame defining a passage having a longitudinal axis and extending therethrough from said first end to said second end, said passage bring of a size sufficient to accommodate said pipe; said frame comprising an upper frame section and at least two pivotable lower frame sections which are pivotally mounted on said upper frame section so as to be movable with respect to each other between an open position and a closed position, whereby said frame can be lowered over said pipe so that said pipe is received within said passage when each of said at least two pivotable lower frame sections is in its open position and said frame at least substantially encompasses said pipe when each of said at least two pivotable lower frame sections is in its closed position and said pipe is within said passage;

a drive assembly for moving said frame along the exterior surface of said pipe so that said pipe effectively moves longitudinally through said passage; and a plurality of units mounted on said frame, at least one of said units being mounted on said upper frame assembly in at least one location intermediate said first end and said second end, at least one of said units being mounted on a first one of said at least two pivotable lower frame sections in at least one location intermediate said first end and said second end, and at least one of said units being mounted on a second one of said at least two pivotable lower frame sections in at least one location intermediate said first end and said second end, each of said plurality of units comprising at least one nozzle directed inwardly toward the exterior surface of said pipe for directing material at the exterior surface of said pipe;

wherein each of said plurality of units is mounted to the frame by a suspension which permits radial motion of the respective unit inwardly and outwardly relative to the axis of the pipe so as to maintain the respective unit at a predetermined distance away from the exterior surface of the pipe when said frame is in the closed position about the pipe.

2. Apparatus in accordance with claim 1, wherein said plurality of units are at least substantially evenly spaced about the circumference of said passage.

3. Apparatus in accordance with claim 1, wherein said drive assembly comprises at least one front wheel mounted to said frame at a first location and at least one rear wheel mounted to said frame at a second location which is spaced along the length of said pipe from said first location, at least one of said at least one front wheel and said at least one rear wheel being a drive wheel, and wherein the plurality of nozzles are mounted to said frame in at least one location intermediate said first location and said second location to cause material from the plurality of nozzles to impinge an annular region of the exterior surface of said pipe as said apparatus moves longitudinally relative to said pipe.

4. Apparatus for treating an exterior surface of a pipe, wherein said pipe has a longitudinal axis, said apparatus comprising:

a frame suitable for being positioned on said pipe, said frame having a first end and a second end, said frame defining a passage having a longitudinal axis and extending therethrough from said first end to said second end, said passage being of a size sufficient to accommodate said pipe; said frame comprising at least two pivotable frame sections which are pivotally mounted so as to be movable with respect to each other between an open position and a closed position, whereby said frame can be lowered over said pipe so that said pipe is received within said passage when each of said at least two pivotable frame sections is in its open position and said frame at least substantially encompasses said pipe when each of said at least two pivotable frame sections is in its closed position and said pipe is within said passage;

a drive assembly for moving said frame along the exterior surface of said pipe so that said pipe effectively moves longitudinally through said passage, said drive assembly comprising at least one front wheel mounted to said frame at a first location and at least one rear wheel mounted to said frame at a second location which is spaced along the length of said pipe from said first location, at least one of said at least one front wheel and said at least one rear wheel being a drive wheel; and a plurality of units mounted on said frame, at least one of said units being mounted on a first one of said at least two pivotable frame sections in at least one location intermediate said first end and said second end, and at least one of said units being mounted on a second one of said at least two pivotable frame sections in at least one location intermediate said first end and said second end, wherein said plurality of units are at least substantially evenly spaced about the circumference of said passage;

wherein each said at least one unit comprises at least one nozzle directed inwardly toward the exterior surface of said pipe for directing material at the exterior surface of said pipe; wherein the plurality of nozzles are mounted to said frame in at least one location intermediate said first location and said second location to cause material from the plurality of nozzles to impinge an annular region of the exterior surface of said pipe as said apparatus moves longitudinally relative to said pipe; and wherein each of said at least two pivotable frame sections has at least one idler wheel mounted thereon for engaging the pipe in a manner to assist the engagement with the pipe of at least one of the at least one front wheel and the at least one rear wheel, whereby each of said at least one pivotable frame sections automatically adjusts its position as the at least one idler wheel mounted thereon follows irregularities of the exterior surface of said pipe during longitudinal movement of said apparatus along the exterior surface of said pipe.

5. Apparatus for treating an exterior surface of a pipe, wherein said pipe has a longitudinal axis, said apparatus comprising:

a frame suitable for being positioned on said pipe, said frame having a first end and a second end, said frame defining a passage having a longitudinal axis and extending therethrough from said first end to said second end, said passage being of a size sufficient to accommodate said pipe;

a drive assembly for moving said frame along the exterior surface of said pipe so that said pipe effectively moves longitudinally through said passage; and at least one unit mounted on said frame in at least one location intermediate said first end and said second end, each said at least one unit comprising at least one nozzle directed inwardly toward the exterior surface of said pipe for directing material at the exterior surface of said pipe;

wherein said frame comprises at least two pivotable frame sections which are pivotally mounted so as to be movable with respect to each other between an open position and a closed position, whereby said frame can be lowered over said pipe so that said pipe is received within said passage when each of said at least two pivotable frame sections is in its open position and said frame at least substantially encompasses said pipe when each of said at least two pivotable frame sections is in its closed position and said pipe is within said passage; and at least one actuator for moving the pivotable frame sections between the open and closed positions and acting to resiliently bias the pivotable frame sections toward the closed position during longitudinal movement of said apparatus along the exterior surface of said pipe.

6. Apparatus for treating an exterior surface of a pipe, wherein said pipe has a longitudinal axis, said apparatus comprising:

a frame suitable or being positioned on said pipe, said frame having a first end and a second end, said frame defining a passage having a longitudinal axis and extending therethrough from said first end to said second end, said passage being of a size sufficient to accommodate said pipe; said frame comprising an upper frame section and at least two lower frame sections pivotally mounted to said upper frame section, whereby each of said at least two lower frame sections can be pivoted with respect to said upper frame section between an open position and a closed position, whereby said frame can be lowered over said pipe so that said pipe is received within said passage when each of said at least two lower frame sections is in its open position and said frame at least substantially encompasses said pipe when each of said at least two lower frame sections is in its closed position and said pipe is within said passage;

a drive assembly for moving said frame along the exterior surface of said pipe so that said pipe effectively moves longitudinally through said passage, said drive assembly comprising at least one front wheel mounted to said upper frame section at a first location and at least one rear wheel mounted to said upper frame section at a second location which is spaced along the length of said pipe from said first location, at least one of said at least one front wheel and said at least one rear wheel being a drive wheel;

a plurality of units mounted on said frame in at least one location intermediate said first location and said second location, at least one of said units being mounted on said upper frame section and at least one of said units being mounted on each said lower frame section, wherein said plurality of units are at least substantially evenly spaced about the circumference of said passage, each said unit comprising at least one nozzle directed inwardly toward the exterior surface of said pipe for directing material at the exterior surface of said pipe to cause material from the nozzles to impinge an annular region of the exterior surface of said pipe as said apparatus moves longitudinally relative to said pipe; and at least two actuators, each of said at least two actuators moving a respective one of the at least two lower frame sections between the open and closed positions and acting to resiliently bias the respective lower frame section toward the closed position during longitudinal movement of said apparatus along the exterior surface of said pipe.

7. Apparatus in accordance with claim 6, wherein each of said at least two lower frame sections has at least one idler wheel mounted thereon for engaging the pipe in a manner to assist the engagement with the pipe of at least one one of the at least one front wheel and the at least rear wheel, whereby each of said at least two at least sections automatically adjusts its position as the lower frame one idler wheel mounted thereon follows irregularities of the pipe surface during longitudinal movement of said apparatus along the exterior surface of said pipe.

8. Apparatus for treating an exterior surface of a pipe, wherein said pipe has a longitudinal axis, said apparatus comprising:

a frame suitable for being positioned on said pipe, said frame having a first end and a second end, said frame defining a passage having a longitudinal axis and extending therethrough from said first end to said second end, said passage being of a size sufficient to accommodate said pipe; said frame comprising an upper frame section and at least two lower frame sections pivotally mounted to said upper frame section, whereby each said lower frame section can be pivoted with respect to said upper frame section between an open position and a closed position, whereby said frame can be lowered over said pipe so that said pipe is received within said passage when each said lower frame section is in its open position and said frame at least substantially encompasses said pipe when each said lower frame section is in its closed position and said pipe is within said passage;

a drive assembly for moving said frame along the exterior surface said pipe so that said pipe effectively moves longitudinally through said passage, said drive assembly comprising at least one front wheel mounted to said upper frame section at a first location and at least one rear wheel mounted to said upper frame section at a second location which is spaced along the length of said pipe from said first location, at least one of said at least one front wheel and said at least one rear wheel being a drive wheel;

at least one unit mounted on said frame at a location intermediate said first location and said second location, each said at least one unit comprising at least one nozzle directed inwardly toward the exterior surface of said pipe for directing material at the exterior surface of said pipe;

at least two actuators, each of the at least two lower actuators moving a respective one of said at least two frame sections between the open and closed positions and acting to resiliently bias the respective lower frame section toward the closed position during longitudinal movement of said apparatus along the exterior surface of said pipe.

9. Apparatus for treating an exterior surface of a pipe, wherein said pipe has a longitudinal axis, said apparatus comprising:

a frame suitable for being positioned on said pipe, said frame having a first end and a second end, said frame defining a passage having a longitudinal axis and extending therethrough from said first end to said second end, said passage being of a size sufficient to accommodate said pipe; said frame comprising an upper frame section and at least one lower frame section pivotally mounted to said upper frame section, whereby each said at least one lower frame section can be pivoted with respect to said upper frame section between an open position and a closed position, whereby said frame can be lowered over said pipe so that said pipe is received within said passage when each said at least one lower frame section is in its open position and said frame at least substantially encompasses said pipe when each said at least one lower frame section is in its closed position and said pipe is within said passage;

a drive assembly for moving said frame along the exterior surface of said pipe so that said pipe effectively moves longitudinally through said passage; and at least one unit mounted on said frame at a location intermediate said first end and said second end, each said at least one unit comprising at least one nozzle directed inwardly toward the exterior surface of said pipe for directing material at the exterior surface of said pipe;

wherein each of said units is mounted to the frame by a suspension which permits radial motion of the respective unit inwardly and outwardly relative to the axis of the pipe so as to maintain the respective unit at a predetermined distance away from the exterior surface of the pipe when said frame is in the closed position about the pipe.

10. Apparatus for moving along an exterior surface of a pipe having a longitudinal axis, said apparatus comprising:

a frame having at least two pivotable frame sections which are pivotally mounted so as to be movable with respect to each other between an open position and a closed position, the pivotable frame sections in the open position allowing the frame to be lowered downwardly onto the pipe, and the pivotable frame sections in the closed position closing about the lower portion of the pipe such that the frame at least partially surrounds said pipe;

a drive assembly mounted to said frame and including at least one drive wheel for engaging the pipe and advancing the frame along the exterior surface of the pipe in the direction of the longitudinal axis of the pipe; and at least one actuator for moving the pivotable frame sections between the open and closed positions and acting to resiliently bias the pivotable frame sections toward the closed position during longitudinal movement of said apparatus along the exterior surface of said pipe.

11. Apparatus in accordance with claim 10, further comprising a plurality of nozzles mounted to said frame, with at least one of said plurality of nozzles being mounted to a first one of said at least two pivotable frame sections, and at least one of said plurality of nozzles being mounted to a second one of said at least two pivotable frame sections.

12. Apparatus in accordance with claim 11, wherein when said at least two pivotable frame sections are in their closed position the nozzles are approximately evenly spaced about the circumference of said pipe.

13. Apparatus for moving along an exterior surface of a pipe having a longitudinal axis, said apparatus comprising:

a frame, said frame including an upper frame section and a pair of lower frame sections, each of said lower frame sections being pivotally mounted to a respective opposite side of the upper frame section for movement of the lower frame sections with respect to the upper frame section between open and closed positions, the lower frame sections in the open position allowing the frame to be lowered downwardly onto the pipe, and the lower frame sections in the closed position closing about the lower portion of the pipe such that the frame at least partially surrounds said pipe;

a drive assembly mounted to said upper frame section and including at least one drive wheel for engaging the pipe and advancing the frame along the exterior surface of the pipe in the direction of the longitudinal axis of the pipe; and at least one actuator for moving the lower frame sections between the open and closed positions and acting to resiliently bias the lower frame sections toward the closed position during longitudinal movement of said apparatus along the exterior surface of said pipe.

14. Apparatus in accordance with claim 13, wherein said upper frame section has a generally inverted U-shape so as to partially surround an upper portion of the pipe when in use, and wherein each of said lower frame sections is pivotally mounted to a respective one of lower opposed edges of said upper frame section.

15. Apparatus in accordance with claim 13, wherein each of said lower frame sections has at least one idler wheel mounted thereon for engaging the pipe in a manner to assist the engagement with the pipe of at least one of the at least one drive wheel, whereby each of said lower frame sections automatically adjusts its position as the at least one idler wheel mounted thereon follows irregularities of the pipe surface during longitudinal movement of said apparatus along the exterior surface of said pipe.

16. Apparatus in accordance with claim 13, wherein said drive assembly comprises two drive wheels mounted on said upper frame for engaging the exterior surface of said pipe at circumferentially spaced apart locations and a drive mechanism for rotating said two drive wheels for moving said frame relative to said pipe when said apparatus is in operation, and wherein each of said lower frame sections has at least one idler wheel mounted thereon for engaging the exterior surface of the pipe at a location generally diagonally from a respective one of said drive wheels to assist the engagement with the pipe of the respective one of the drive wheels, whereby each of said lower frame sections automatically adjusts its position as the at least one idler wheel mounted thereon follows irregularities of the pipe surface during longitudinal movement of said apparatus along the exterior surface of said pipe.

17. Apparatus in accordance with claim 13, further comprising a plurality of nozzles mounted to said frame, with at least one of said plurality of nozzles being mounted to said upper frame section, at least one of said plurality of nozzles being mounted to a first one of said lower frame sections, and at least one of said plurality of nozzles being mounted to a second one of said lower frame sections.

18. Apparatus in accordance with claim 17, wherein said drive assembly comprises at least one front wheel mounted to said upper frame section at a first location and at least one rear wheel mounted to said upper frame section at a second location which is spaced along the length of said pipe from said first location, at least one of said at least one front wheel and said at least one rear wheel being said at least one drive wheel, and wherein said plurality of nozzles are mounted to said frame in at least one location intermediate said first location and said second location to cause material from the plurality of nozzles to impinge an annular region the exterior surface of said pipe as said apparatus moves longitudinally relative to said pipe.

19. Apparatus in accordance with claim 18, wherein each of said lower frame sections has at least one idler wheel mounted thereon for engaging the pipe in a manner to assist the engagement with the pipe of at least one of the at least one front wheel and the at least one rear wheel, whereby each of said lower frame sections automatically adjusts its position as the at least one idler wheel mounted thereon follows irregularities of the pipe surface during longitudinal movement of said apparatus along the exterior surface of said pipe.

20. Apparatus in accordance with claim 18, further comprising a plurality of jet modules, each of said plurality of jet modules having at least one of said plurality of nozzles mounted thereon, wherein when said lower frame sections are in their closed position the jet modules are approximately evenly spaced about the circumference of said pipe.

21. Apparatus in accordance with claim 20, wherein each of said plurality of jet modules is mounted to the frame by a suspension which permits radial motion of the respective jet module inwardly and outwardly relative to the axis of the pipe so as to maintain the respective jet module at a predetermined distance away from the exterior surface of the pipe when said frame is in the closed position about the pipe.

22. Apparatus for moving along an exterior surface of a pipe having a longitudinal axis, said apparatus comprising:

a frame having at least two pivotable frame sections which are pivotally mounted so as to be movable with respect to each other between an open position and a closed position, the pivotable frame sections in the open position allowing the frame to be lowered downwardly onto the pipe, and the pivotable frame sections in the closed position closing about the lower portion of the pipe such that the frame at least partially surrounds said pipe;

a drive assembly mounted to said frame and including at least one drive wheel for engaging the pipe and advancing the frame along the exterior surface of the pipe in the direction of the longitudinal axis of the pipe;

an adjustable hinge stop establishing a preset position for one of said at least two pivotable frame sections; and at least one actuator to move the at least two pivotable frame sections relative to each other from the open position to a closed position as determined by the adjustable hinge stop.

23. Apparatus in accordance with claim 22, further comprising a plurality of nozzles mounted to said frame, with at least one of said plurality of nozzles being mounted to a first one of said at least two pivotable frame sections, and at least one of said plurality of nozzles being mounted to a second one of said at least two pivotable frame sections.

24. Apparatus for moving along an exterior surface of a pipe having a longitudinal axis, said apparatus comprising:

a frame, said frame including an upper frame section, and a pair of lower frame sections, each of said lower frame sections being pivotally mounted to a respective one of opposite sides of the upper frame section for movement between open and closed positions, the lower frame sections in the open position allowing the frame to be lowered downwardly onto the pipe, and the lower frame sections in the closed position closing about the lower portion of the pipe such that the frame at least partially surrounds said pipe;

a drive assembly mounted to said upper frame section and including at least one drive wheel for engaging the pipe and advancing the frame along the exterior surface of the pipe in the direction of the longitudinal axis of the pipe; and a pair of adjustable hinge stops, each of said adjustable hinge stops establishing a preset position for a respective one of said lower frame sections; and at least one actuator to move each of the lower frame sections from its open position to its closed position as determined by the respective adjustable hinge stop.

25. Apparatus in accordance with 24, wherein each of said lower frame sections has at least one idler wheel mounted thereon for engaging the pipe in a manner to assist the engagement with the pipe of at least one of the at least one drive wheel, whereby each of said lower frame sections automatically adjusts its position as the at least one idler wheel mounted thereon follows irregularities of the pipe surface.

26. Apparatus in accordance with claim 24, further comprising a plurality of nozzles mounted to said frame, with at least one of said plurality of nozzles being mounted to said upper frame section, at least one of said plurality of nozzles being mounted to a first one of said lower frame sections, and at least one of said plurality of nozzles being mounted to a second one of said lower frame sections.

27. Apparatus in accordance with claim 26, wherein said drive assembly comprises at least one front wheel mounted to said upper frame section at a first location and at least one rear wheel mounted to said upper frame section at a second location which is spaced along the length of said pipe from said first location, at least one of said at least one front wheel and said at least one rear wheel being said at least one drive wheel, and wherein said plurality of nozzles are mounted to said frame in at least one location intermediate said first location and said second location to cause material from the plurality of nozzles to impinge an annular region of the exterior surface of said pipe as said apparatus moves longitudinally relative to said pipe.

28. Apparatus in accordance with claim 27, wherein each of said lower frame sections has at least one idler wheel mounted thereon for engaging the pipe in a manner to assist the engagement with the pipe of at least one of the at least one front wheel and the at least one rear wheel, whereby each of said lower frame sections automatically adjusts its position as the at least one idler wheel mounted thereon follows irregularities of the pipe surface during longitudinal movement of said apparatus along the exterior surface of said pipe.

29. Apparatus in accordance with claim 27, further comprising a plurality of jet modules, each of said plurality of jet modules having at least one of said plurality of nozzles mounted thereon, wherein when said lower frame sections are in their closed position the jet modules are approximately evenly spaced about the circumference of said pipe.

30. Apparatus in accordance with claim 29, wherein each of said plurality of jet modules is mounted to the frame by a suspension which permits radial motion of the respective jet module inwardly and outwardly relative to the axis of the pipe so to maintain the respective jet module at a predetermined distance away from the exterior surface of the pipe when said frame is in the closed position about the pipe.

31. Apparatus for moving along an exterior surface of a pipe having a longitudinal axis, said apparatus comprising:

a frame, said frame including an upper frame section and a pair of lower frame sections, each of said lower frame sections being pivotally mounted to a respective one of opposed sides of the upper frame section for movement between open and closed positions, the lower frame sections in the open position allowing the frame to be lowered downwardly onto the pipe, and the lower frame sections in the closed position closing about the lower portion of the pipe such that the frame at least partially surrounds said pipe;

a drive assembly mounted to said upper frame section and including at least one first wheel for engaging the pipe and advancing the frame along the exterior surface of the pipe in the direction of the longitudinal axis of the pipe; and each of said lower frame sections comprising a pair of independently pivotal frame portions, a first one of each pair of said independently pivotal frame portions being pivotal from an open position to a predetermined closed position relative to said upper frame section, a second one of each pair of independently pivotal frame portions having at least one second wheel mounted thereon for engaging the pipe in a manner to assist the engagement with the pipe of the at least one first wheel;

an actuator for moving the second one of each pair of independently pivotal frame portions between the open and closed positions and acting to resiliently bias the second one of each pair of independently pivotal frame portions toward the closed position independently of the position of the first one of the respective pair of independently pivotal frame portions as the respective at least one second wheel follows irregularities of the pipe surface such that each of the second wheels engages the pipe with force to assist the at least one first wheel in providing tractive force.

32. Apparatus in accordance with claim 31, wherein the predetermined closed position for each first one of each pair of said independently pivotal frame portions is provided by an adjustable hinge stop.

33. Apparatus in accordance with claim 31, further comprising at least one actuator for moving the first one of each pair of independently pivotal frame portions to the predetermined closed position.

34. Apparatus in accordance with claim 31, wherein the at least one second wheel on each of the second ones of said pairs is at least one idler wheel.

35. Apparatus in accordance with claim 31, further comprising a plurality of nozzles mounted to said frame, with at least one of said plurality of nozzles being mounted to said upper frame section, at least one of said plurality of nozzles being mounted to a first one of said lower frame sections, and at least one of said plurality of nozzles being mounted to a second one of said lower frame sections.

36. Apparatus in accordance with claim 35, further comprising a plurality of jet modules, each of said plurality of jet modules having at least one of said plurality of nozzles mounted thereon, wherein when said lower frame sections are in their closed position the jet modules are approximately evenly spaced about the circumference of said pipe.

37. Apparatus in accordance with claim 36, wherein each of said plurality of jet modules is mounted to the frame by a suspension which permits radial motion of the respective jet module inwardly and outwardly relative to the axis of the pipe so as to maintain the respective jet module at a predetermined distance away from the exterior surface of the pipe when said frame is in the closed position about the pipe.

* * * * *

UNITED STATES PATENT AND TRADEMARK OFFICE

CERTIFICATE OF CORRECTION

PATENT NO. : 5,361,791

DATED : November 8, 1994

INVENTOR(S) : Gordon R. Chapman et al

It is certified that error appears in the above-indentified patent and that said Letters Patent is hereby corrected as shown below:

Column 10, line 53, delete "bring" and insert --being--.

Column 13, line 6, delete "or" and insert --for--.

Column 13, line 62, delete "one one of" and insert --one of--.

Column 13, line 63, after "at least" (first occurrence), insert --one--.

Column 13, lines 63-64, delete "at least two at least sections" and insert --at least two lower frame sections--.

Column 13, line 65, delete "lower frame one idler" and insert --at least one idler--.

Column 14, line 24, after "surface", insert --of--.

Column 14, lines 40-41, delete "each of the at least two lower actuators" and insert --each of said at least two actuators--.

Column 14, lines 41-42, delete "one of said at least two frame sections" and insert --one of the at least two lower frame sections--.

Column 16, line 62, after "region", insert --of--.

UNITED STATES PATENT AND TRADEMARK OFFICE

CERTIFICATE OF CORRECTION

PATENT NO. : 5,361,791

DATED : November 8, 1994

INVENTOR(S) : Gordon R. Chapman et al

It is certified that error appears in the above-indentified patent and that said Letters Patent is hereby corrected as shown below:

Column 18, line 62, after "so", insert --as--.

Signed and Sealed this

Twenty-fourth Day of January, 1995

Bruce Lehman

*Attest:*

BRUCE LEHMAN

*Attesting Officer*

*Commissioner of Patents and Trademarks*